US012245702B2

(12) United States Patent
Hayashi

(10) Patent No.: US 12,245,702 B2
(45) Date of Patent: Mar. 11, 2025

(54) CHAIR HAVING A MOVABLE SEAT

(71) Applicant: KOKUYO CO., LTD., Osaka (JP)

(72) Inventor: Katsuaki Hayashi, Osaka (JP)

(73) Assignee: KOKUYO CO., LTD., Osaka (JP)

( * ) Notice: Subject to any disclaimer, the term of this patent is extended or adjusted under 35 U.S.C. 154(b) by 111 days.

(21) Appl. No.: 17/944,753

(22) Filed: Sep. 14, 2022

(65) Prior Publication Data

US 2023/0108179 A1 Apr. 6, 2023

(30) Foreign Application Priority Data

Oct. 1, 2021 (JP) ..... 2021-162894

(51) Int. Cl.
*A47C 1/032* (2006.01)
*A47C 3/026* (2006.01)
*A47C 3/18* (2006.01)

(52) U.S. Cl.
CPC ..... *A47C 3/026* (2013.01); *A47C 3/18* (2013.01); *A47C 1/032* (2013.01)

(58) Field of Classification Search
CPC ..... A47C 1/032; A47C 3/026; A47C 1/03288; A61G 5/1081
USPC ..... 297/314, 461
See application file for complete search history.

(56) References Cited

U.S. PATENT DOCUMENTS 144,664 A * 11/1873 Doremus ..... F16F 15/08 248/632
1,358,640 A * 11/1920 Koyama ..... A47C 9/002 297/302.4 X
2,184,988 A * 12/1939 Collier ..... A47C 3/026 248/575
2,796,920 A * 6/1957 Cowles ..... A47C 7/448 297/291 X
3,080,195 A 3/1963 Berg
3,259,431 A * 7/1966 Gale ..... A47C 3/12 297/440.22
3,309,137 A * 3/1967 Wiebe ..... A47C 3/18 297/302.1
3,813,069 A * 5/1974 Fletcher ..... A47C 3/026 297/326 X (Continued)

FOREIGN PATENT DOCUMENTS

CN 109480521 A 3/2019
JP 2009-82521 A 4/2009
JP 2009-297319 A 12/2009

OTHER PUBLICATIONS

Extended European Search Report dated Feb. 10, 2023, issued in counterpart EP Application No. 22197050.2. (8 pages).

*Primary Examiner* — Rodney B White
(74) *Attorney, Agent, or Firm* — WHDA, LLP

(57) ABSTRACT

The chair can attain smooth movement of a seat by using a rolling surface. The chair includes an upper base unit (31) and a lower base unit (32) facing each other, and a seat (1) that is provided in the upper base unit (31) and swings when the upper base unit (31) rolls with respect to the lower base unit (32), and the upper base unit (31), which is at least one of the upper base unit (31) and the lower base unit (32), includes a rolling surface (312*a*) being curved. In the chair, a region having a different curvature exists in a part of the rolling surface (312*a*), and an elastic member (33) is interposed between the region having the different curvature and a corresponding region of an opposing surface.

15 Claims, 25 Drawing Sheets

(56) References Cited

U.S. PATENT DOCUMENTS 3,863,982 A * 2/1975 Sandham ..... A47C 7/448 297/302.1 X
4,099,697 A * 7/1978 Von Schuckmann .... A47C 3/30 297/314 X
4,372,606 A * 2/1983 Faull ..... A47C 3/025 297/313
2,132,291 A * 10/1983 Fitos ..... A47C 9/002 297/314 X
4,598,946 A * 7/1986 Cone ..... A47D 13/107 297/258.1 X
4,605,334 A * 8/1986 Kalvatn ..... F16C 11/00 297/314 X
4,871,208 A * 10/1989 Hodgdon ..... A47C 3/026 297/302.1 X
4,890,886 A * 1/1990 Opsvik ..... A47C 7/448 297/313 X
4,974,904 A * 12/1990 Phillips ..... A47C 9/002 297/258.1
5,590,930 A * 1/1997 Glockl ..... A47C 3/0257 297/440.1
5,649,740 A * 7/1997 Hodgdon ..... A47C 1/03288 297/325 X
5,728,049 A * 3/1998 Alberts ..... A47C 9/002 297/314 X
5,769,492 A * 6/1998 Jensen ..... A47C 9/002 297/314 X
6,033,021 A * 3/2000 Udo ..... A47C 9/002 297/314 X
6,176,548 B1 * 1/2001 Thole ..... A47C 9/002 297/329
6,209,958 B1 * 4/2001 Thole ..... A47C 3/026 297/325
6,481,795 B1 * 11/2002 Pettibon ..... A47C 3/18 297/314 X
6,523,895 B1 * 2/2003 Vogtherr ..... A47C 3/026 297/300.1
6,685,268 B2 * 2/2004 Meyer ..... A47C 9/002 297/314 X
6,688,689 B1 * 2/2004 Thorn ..... A47C 7/14 297/314 X
6,863,017 B2 * 3/2005 Charles ..... B60N 2/2839 297/314 X
7,063,386 B2 * 6/2006 Dowty ..... B64D 11/0636 297/314 X
7,100,983 B1 * 9/2006 Gant ..... A47C 3/025 297/314 X
7,396,080 B2 * 7/2008 Suhr ..... A47C 7/14 297/313
7,547,067 B2 * 6/2009 Keilhauer ..... A47C 3/02 297/314 X
7,789,463 B2 * 9/2010 Gang ..... A47C 9/002 297/314 X
7,806,479 B2 * 10/2010 Jensen ..... A47C 9/002 297/258.1 X
7,922,247 B2 * 4/2011 Dickie ..... A47C 7/14 297/314 X
7,938,487 B2 * 5/2011 Fismen ..... A47C 3/0252 297/302.6
7,938,489 B2 * 5/2011 Nazari ..... A47C 3/0257 297/314 X
8,888,184 B2 * 11/2014 Meyer ..... A47C 1/03255 297/325
9,060,612 B2 * 6/2015 Lee ..... A47C 9/002
9,289,067 B2 * 3/2016 Meyer ..... A47C 7/14
9,398,811 B1 * 7/2016 Williams ..... A47C 3/12
9,439,513 B2 * 9/2016 Walser ..... A47C 7/004
9,629,465 B2 * 4/2017 Williams ..... A47C 3/18
9,839,296 B2 * 12/2017 Ballendat ..... A47C 7/44
10,772,427 B2 * 9/2020 Schuppler ..... A47C 7/44
11,097,153 B1 * 8/2021 Lee ..... A63B 22/18
11,103,072 B2 * 8/2021 Rheault ..... A47C 9/007
11,439,235 B2 * 9/2022 Taylor, II ..... A47C 7/14
11,540,637 B2 * 1/2023 Sugano ..... A47C 7/142
11,812,865 B2 * 11/2023 Costaglia ..... A47C 9/002
2002/0043846 A1 * 4/2002 Brauning ..... A47C 7/448 297/314
2007/0102979 A1 * 5/2007 Tedesco ..... A47C 3/30 297/461
2007/0241599 A1 * 10/2007 Hodgdon ..... A47C 1/023 297/313
2013/0241253 A1 * 9/2013 Harrison ..... F16M 11/14 297/258.1 X
2016/0081483 A1 * 3/2016 Harrison ..... A47C 3/185 297/217.2

* cited by examiner

CHAIR HAVING A MOVABLE SEAT

CROSS-REFERENCE TO RELATED APPLICATIONS

This application claims priority of Japanese Patent Applications No. 2021-162894 filed on Oct. 1, 2021. The contents of the applications are incorporated herein by reference in their entirety.

BACKGROUND

Field of the Invention

The present invention relates to a chair that is suitably utilized in an office or the like and in which a seat is tiltable.

Description of the Related Documents

For example, chairs in which a seat is tiltable are known from Japanese Unexamined Patent Application Publication No. 2009-82521 and Japanese Unexamined Patent Application Publication No. 2009-297319 (hereinafter referred to as Patent Documents 1 and 2).

Patent Document 1 describes a configuration in which a plurality of fluid bags are connected by a flow path and a seat is tilted when air moves.

Patent Document 2 describes a configuration in which a plurality of independent air cushions are covered with a cover member and fitted into a recess of a seat to provide a cushioning property to a person sitting in the chair.

In the configurations of Patent Documents 1 and 2, the seat can move freely by the cushioning effect. However, the degree of freedom of deformation of the seat is too high for a seated person to hold his or her posture on the seat, and therefore, the seated person needs to follow a movement of the seat rather than the seat following a movement of the seated person. As a result, the conventional seats are not designed suitably for supporting a movement of the seated person continuously changing his or her posture while the seated person balances his or her load.

To solve such a problem, it is conceivable to provide a chair including a curved rolling surface in at least one of an upper base unit and a lower base unit, and, in the chair, when the upper base unit rolls with respect to the lower base unit, a seat provided in the upper base unit swings (to the front, rear, left, and right).

However, if the rolling surface includes a region having a different curvature (including a case where the curvature of the rolling surface is uneven) such as a hole or a flat portion due to some reason, rattling or an undesirable noise due to the change in curvature is easily generated during an operation of the upper base unit and therefore, an operation of the seat.

Such a problem may also occur when adopting a configuration in which the seat rolls only in a front-rear direction or only in a left-right direction.

The present invention has been made by focusing on such a problem, and an object thereof is to realize an unprecedented chair in which movement of a seat by using a rolling surface can be smoothly performed.

SUMMARY

The present invention adopts the following means to achieve such an object.

That is, a chair of the present invention includes an upper base unit and a lower base unit facing each other, and a seat that is provided in the upper base unit and swings when the upper base unit rolls with respect to the lower base unit, and at least one of the upper base unit and the lower base unit includes a rolling surface being curved. In the chair, a region having a different curvature exists in a part of the rolling surface, and an elastic member is interposed between the region having the different curvature and a corresponding region of an opposing surface.

According to such a configuration, the upper base unit can follow a movement of a seated person while rolling via the rolling surface, and thus, the seated person can easily find a weight balance while supporting his or her own weight, and can change his or her posture stably and continuously. At that time, even if a region having a different curvature exists in a part of the rolling surface, the elastic member interposed between the region of the rolling surface and a corresponding region of the opposing surface makes it possible to effectively prevent rattling and generation of an undesirable noise due to the change in curvature, during the operation of the upper base unit, and therefore, the operation of the seat.

In a specific aspect, the chair includes a connection member that connects the upper base unit and the lower base unit, and the region having the different curvature is a relief hole for inserting the connection member.

This is particularly effective in a case where the upper base unit swings in a direction of 360 degrees with respect to the lower base unit, and the relief hole is provided at three or more locations around a swing center.

A specific example of the connection member includes a rotation stop member that restricts a relative movement of the upper base unit and the lower base unit in a rotation direction.

Another specific example of the connection member includes a detachment stop member that restricts a separation between the upper base unit and the lower base unit.

Still another specific example of the connection member includes a constitution component of a braking mechanism that slows down a movement of a seat by a relative movement of two members.

Still another specific example of the connection member includes a return spring interposed between the upper base unit and the lower base unit and the return spring returns the upper base unit to a predetermined reference position with respect to the lower base unit.

In a preferable aspect, the elastic member is an elastic resin foam body interposed between the upper base unit and the lower base unit.

In another preferable aspect, the elastic member is an elastic sheet interposed between the upper base unit and the lower base unit.

The elastic member is preferably also provided with a relief hole.

The configuration that employs the rotation stop member is extremely useful when applied to a chair in which an arm is attached to the lower base unit and a seat is attached to the upper base unit.

The present invention has the configuration described above, and thus, it is possible to follow a free movement of a seated person via a rolling surface, and, even if the rolling surface includes a region having different curvature (including a case where the curvature of the rolling surface is uneven) such as a hole or a flat portion due to some reason, rattling and an undesirable noise can be suppressed. Thus, it is possible to provide a novel, useful chair that can appropriately support a movement of the seated person continuously changing his or her posture while balancing his or her load.

DETAILED DESCRIPTION

An embodiment of the present invention will be described below with reference to the drawings.

Figure 1:
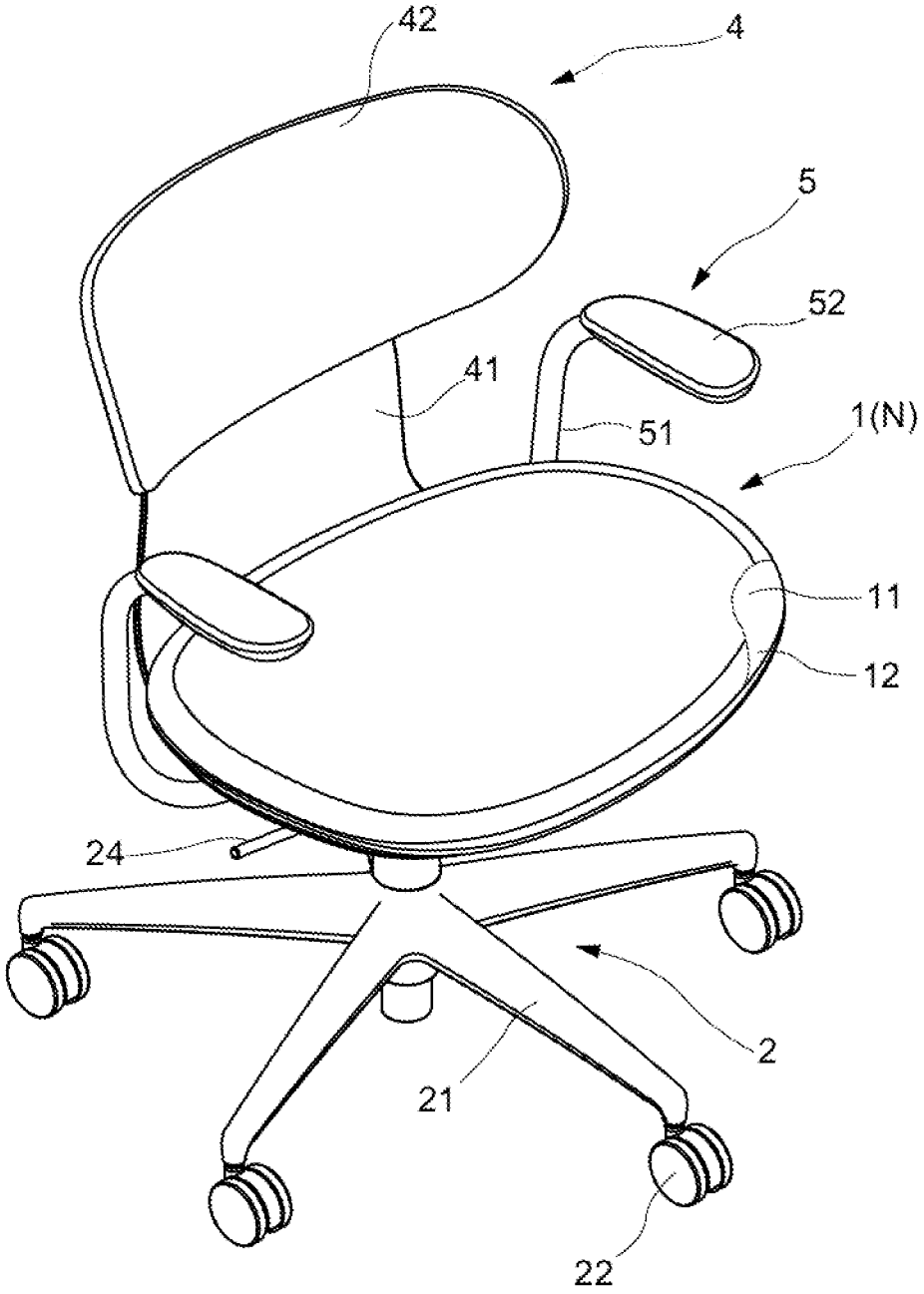
FIG. 1 is a perspective view of a chair according to an embodiment of the present invention.
Figure 2:
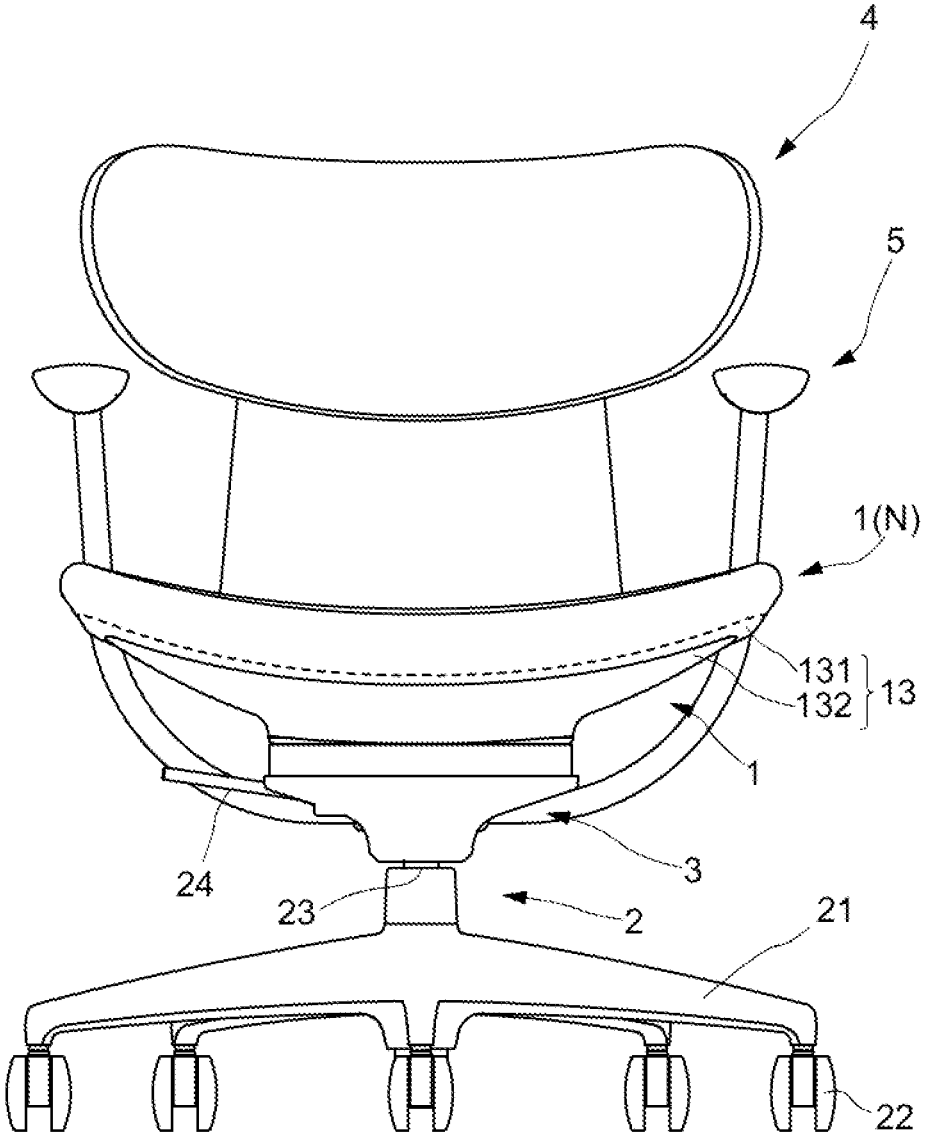
FIG. 2 is a front view of the chair.
Figure 3:
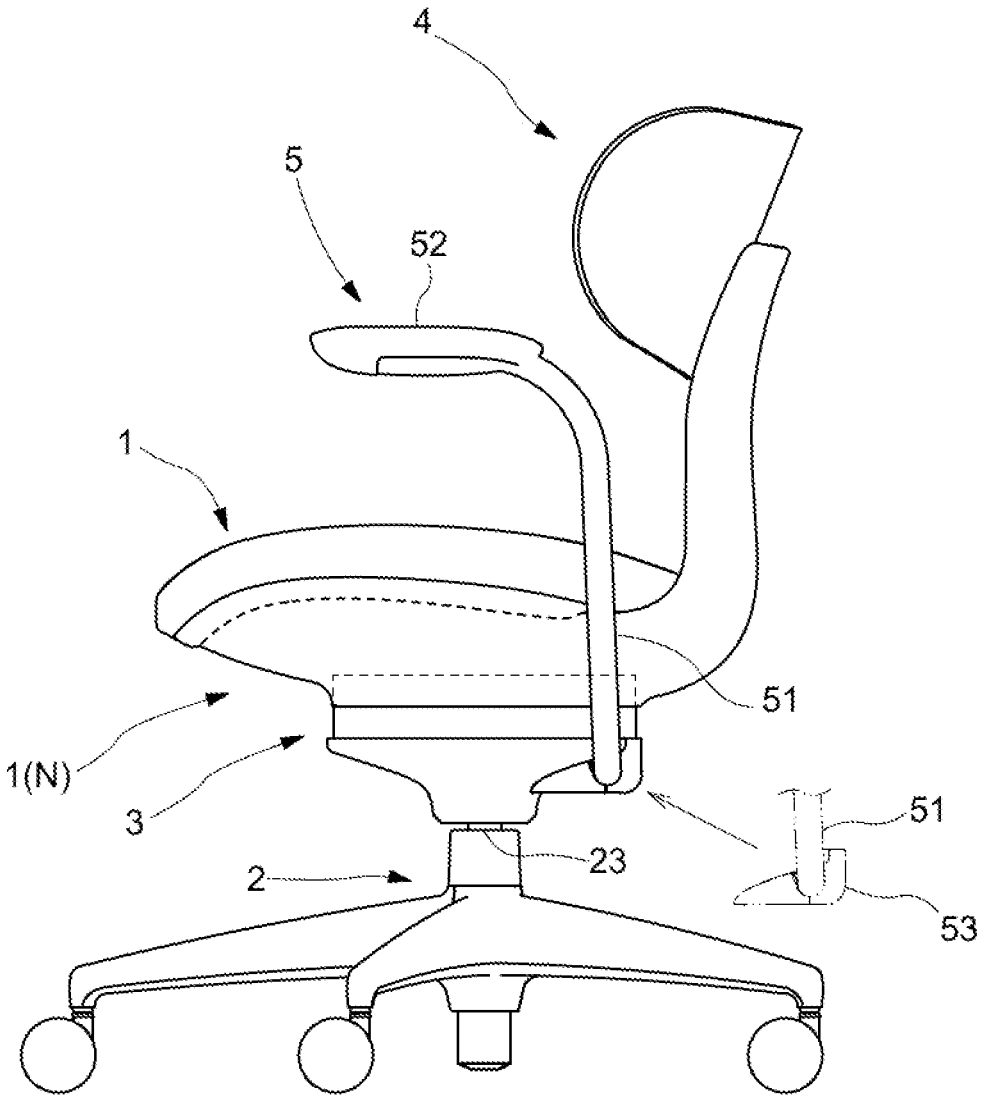
FIG. 3 is a right side view of the chair.
Figure 4:
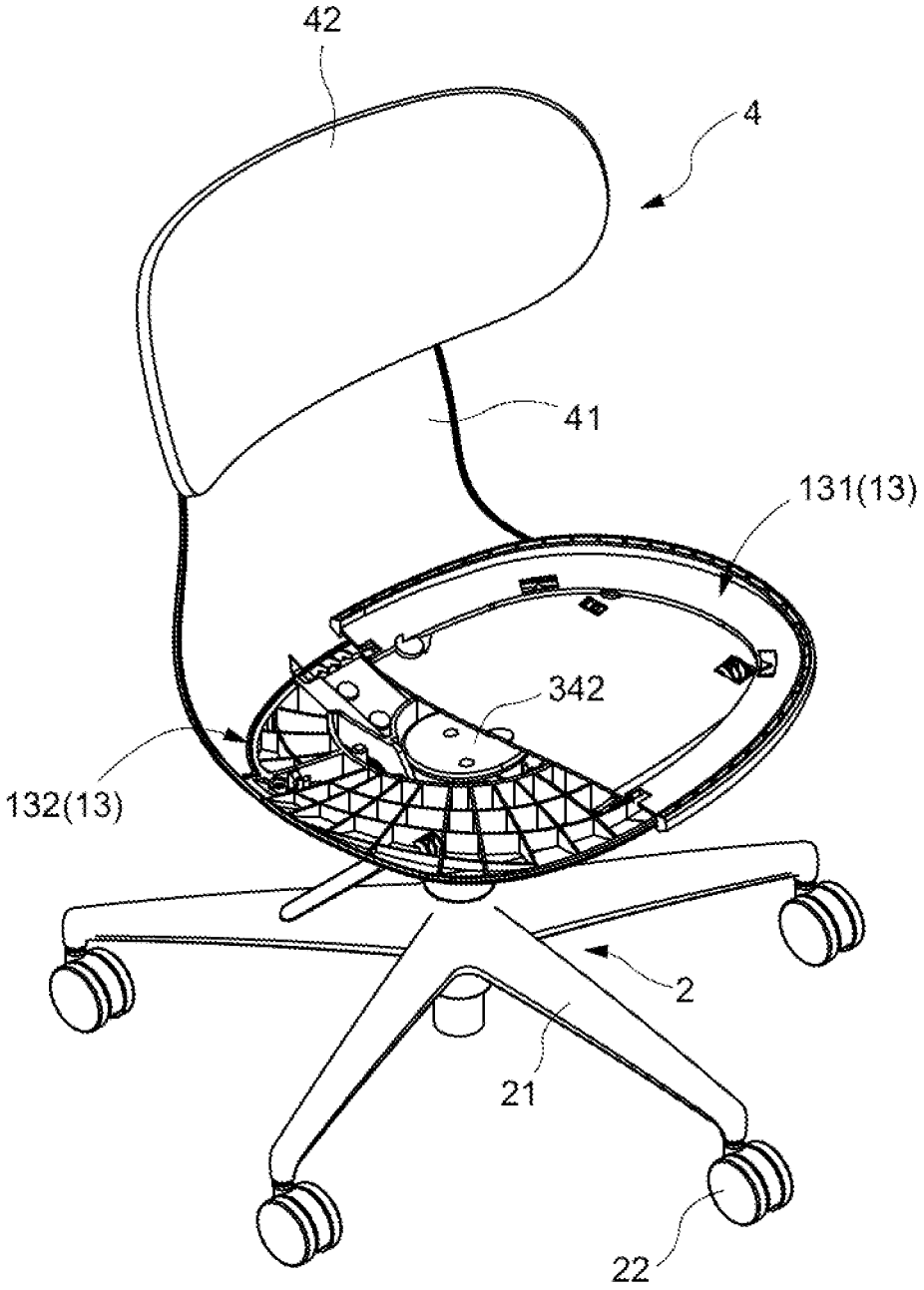
FIG. 4 is a perspective view illustrating the chair in which a part of a seat is omitted.
Figure 5:
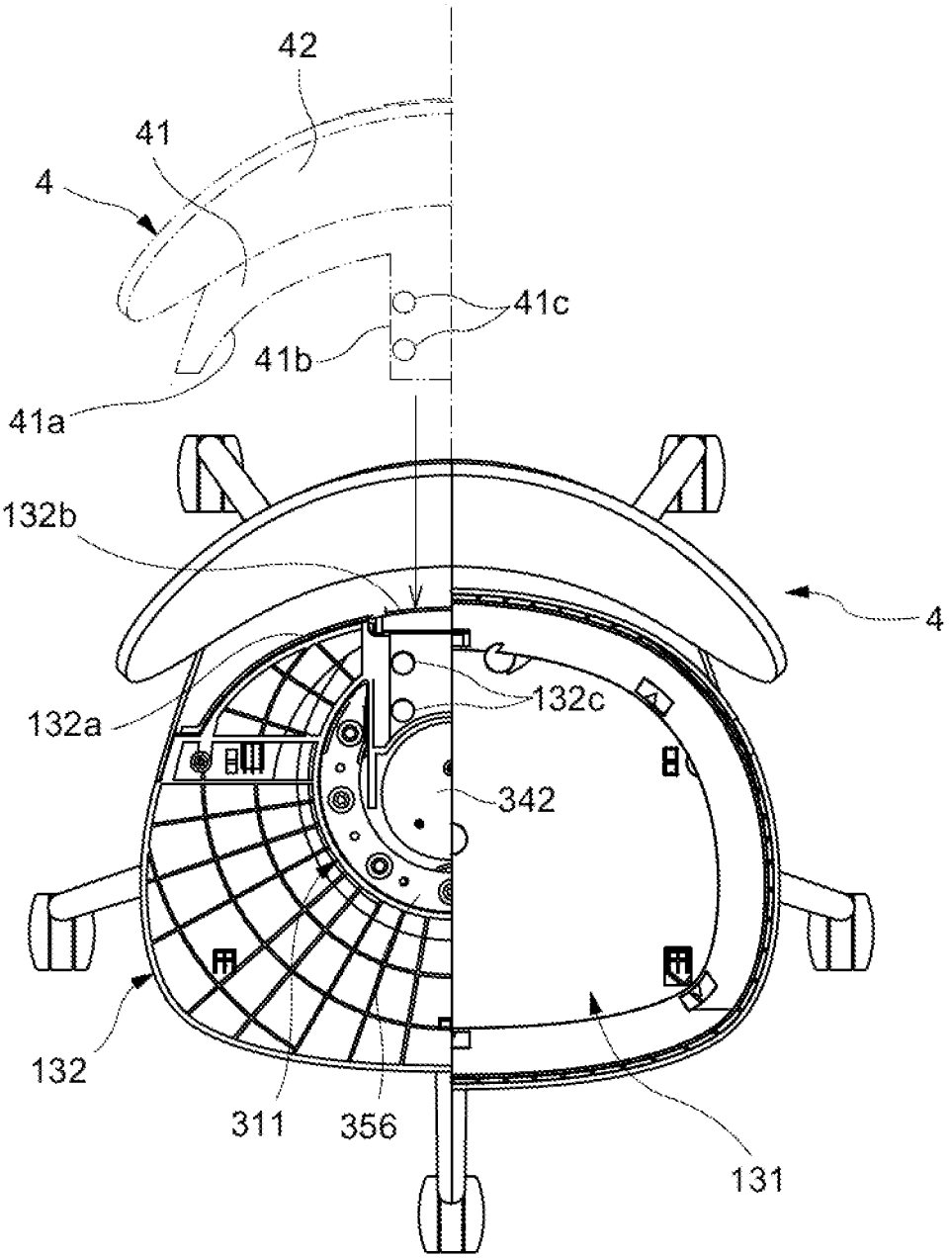
FIG. 5 is a plan view illustrating the chair in which a part of the seat is omitted.
Figure 17:
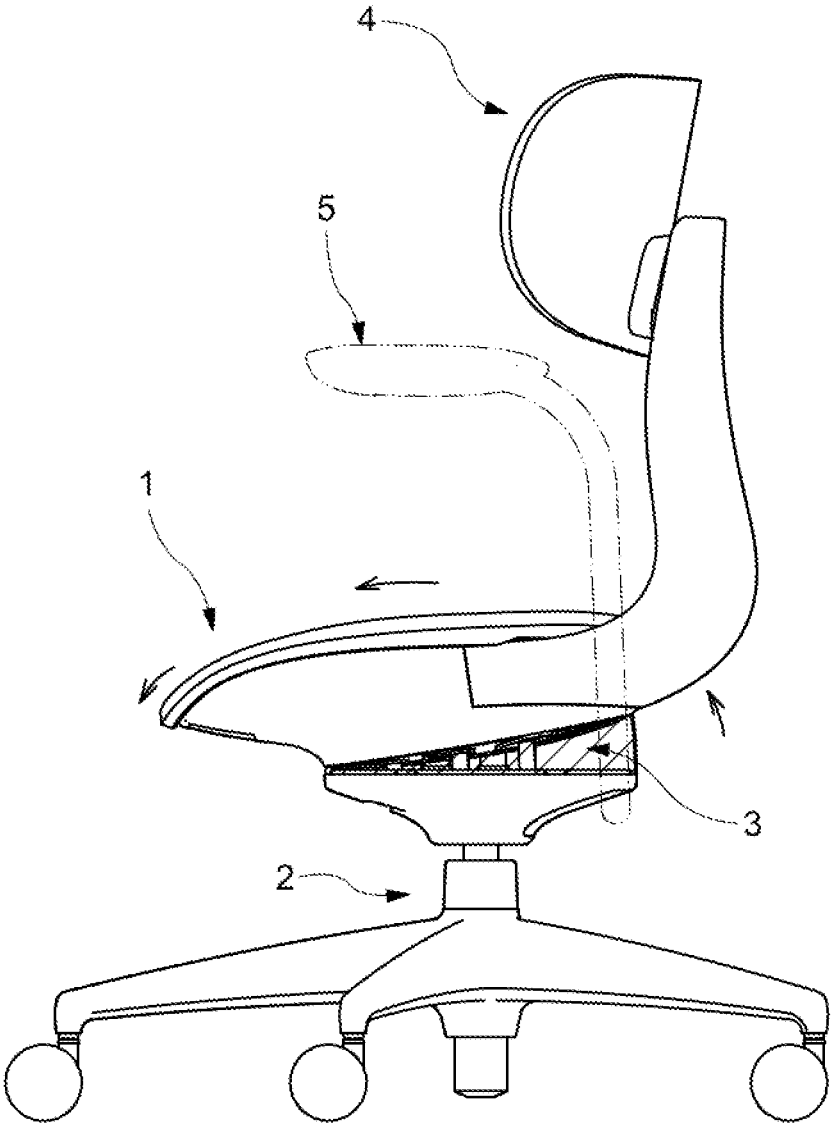
FIG. 17 is a right side view illustrating a state where the seat is tilted forward.
Figure 18:
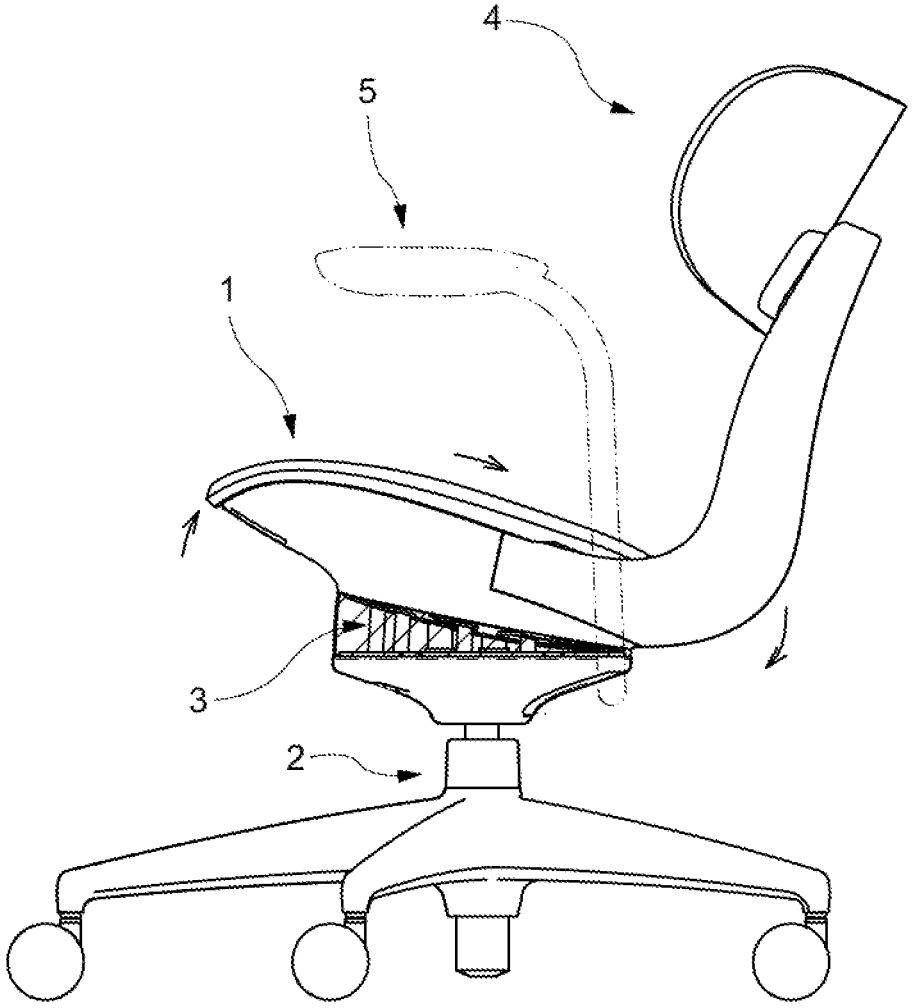
FIG. 18 is a right side view illustrating a state where the seat is tilted rearward.
Figure 22:
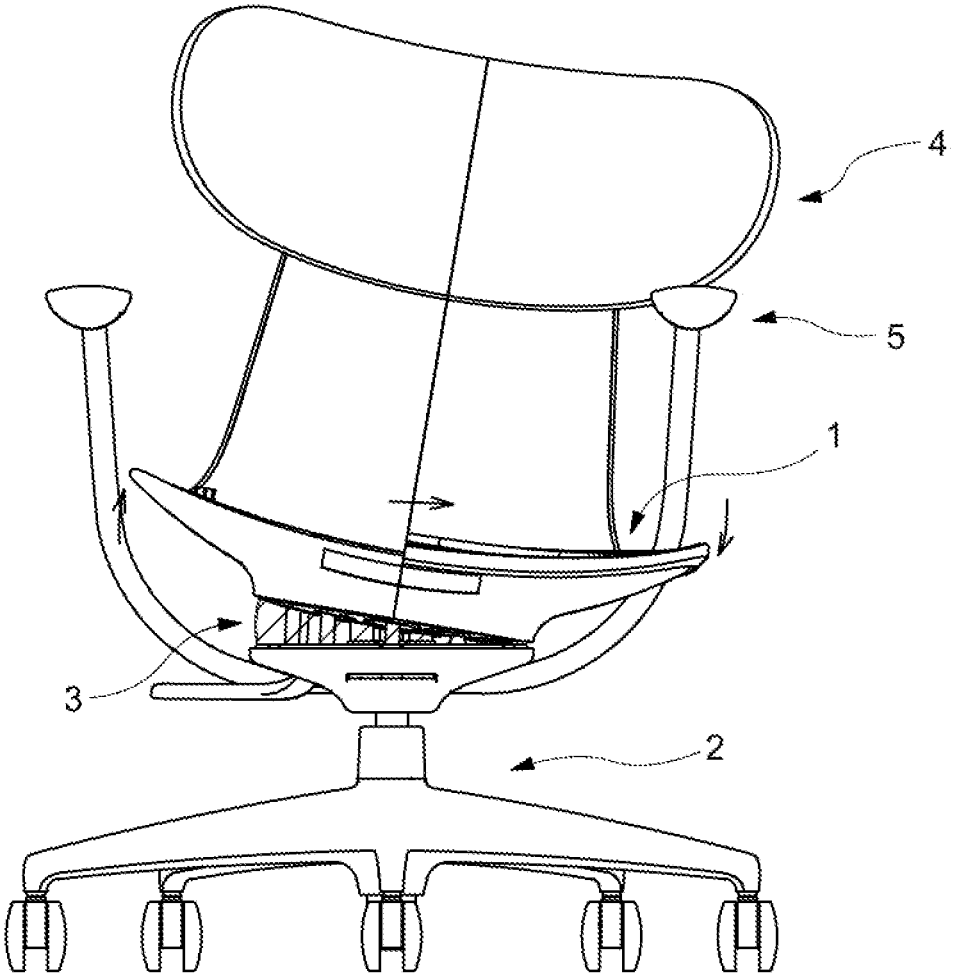
FIG. 22 is a front view illustrating a state where the seat is tilted to the left and right.

FIGS. 1 to 3 illustrate an outer appearance of a chair according to the embodiment, and FIGS. 4 and 5 illustrate views in which a part of a seat 1 is omitted. As illustrated in the drawings, in the chair, a movement mechanism 3 is provided as a movable support between the seat 1 and a leg 2, a back 4 is attached to move integrally with the seat 1, and arms 5 are attached not to move integrally with the seat 1 and the back 4. FIGS. 17 and 18 illustrate a state where the seat 1 is moved in a front-rear direction, and FIG. 22 illustrates a state where the seat 1 is moved in a left-right direction.

In the seat 1, a circumference of a seat main body 11 is covered with upholstery 12, and the seat 1 is attached to the movement mechanism 3 via a seat shell 13. The seat shell 13 includes an inner seat shell 131 attached to a bottom surface of the seat main body 11 and an outer seat shell 132 that backs up the inner seat shell 131 and secures the connection to the movement mechanism 3.

Figure 6:
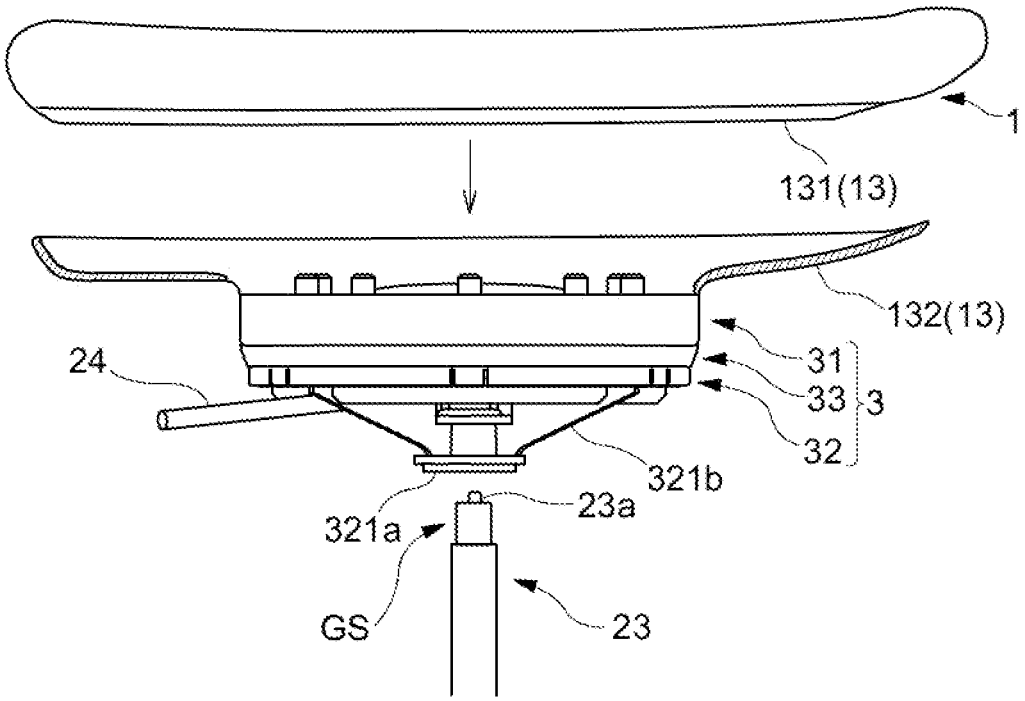
FIG. 6 is a diagram illustrating a relationship between a movement mechanism, the seat, and a leg constituting the chair.

The leg 2 includes casters 22 at a lower end of a leg vane 21, and a leg support post 23 erected from a center portion of the leg vane 21, and the seat 1 is rotatably attached to an upper end side of the leg support post 23. The leg support post 23 can be extended and contracted by a gas spring mechanism GS illustrated in FIG. 6 incorporated therein. In FIG. 6, a reference numeral 24 indicates an operation lever for operating an operated unit 23*a* of the gas spring mechanism GS.

As illustrated in FIGS. 6 to 11, in the movement mechanism 3, an upper base unit 31 and a lower base unit 32 are arranged to face each other, the lower base unit 32 is attached to the leg support post 23, and the seat 1 is attached to the upper base unit 31. An elastic member 33 is interposed between the upper base unit 31 and the lower base unit 32. The periphery of the elastic member 33 is covered with a cover member 6, as illustrated in FIGS. 19, 20, 23, and FIGS. 25A to 25C, but the cover member 6 is omitted in the other drawings. Further, in FIGS. 10, 13, and the like, the elastic member 33 is omitted.

Figure 19:
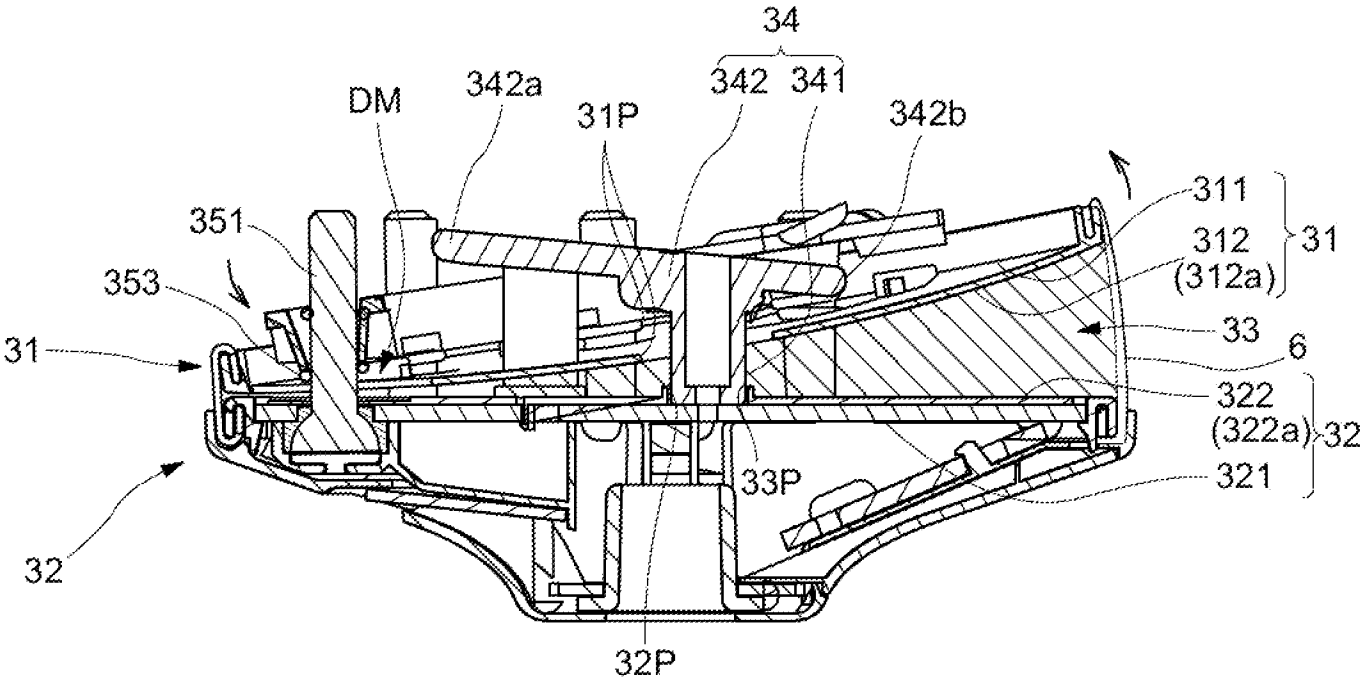
FIG. 19 is a cross-sectional view corresponding to FIG. 16 when the seat is tilted forward.
Figure 20:
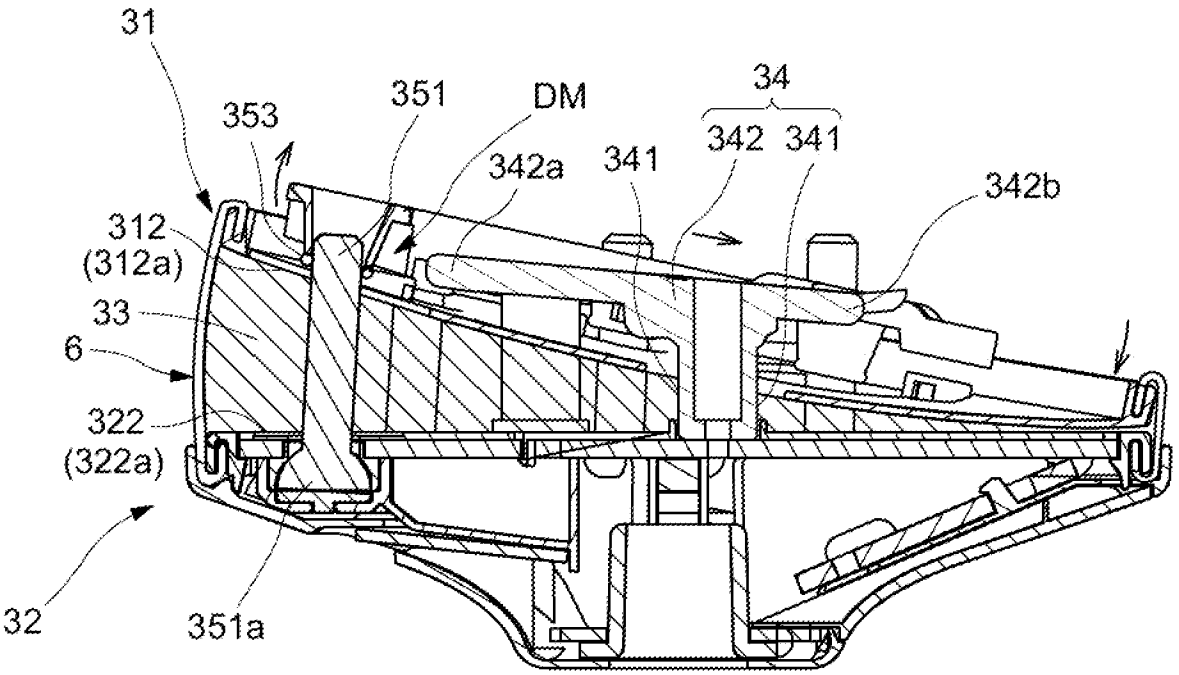
FIG. 20 is a cross-sectional view corresponding to FIG. 16 when the seat is tilted rearward.
Figure 21:
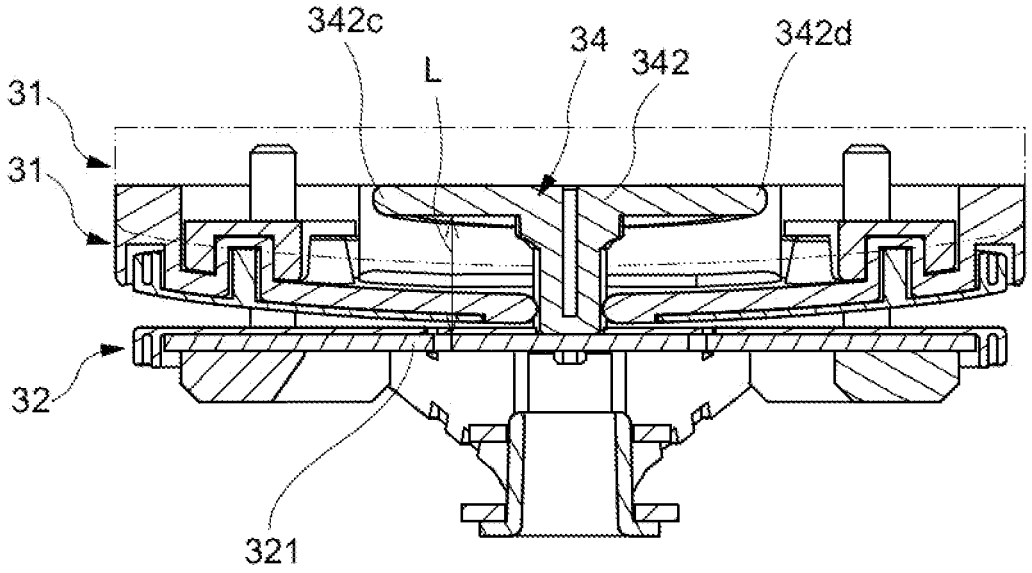
FIG. 21 is a cross-sectional view taken along line XXI-XXI in FIG. 7.
Figure 23:
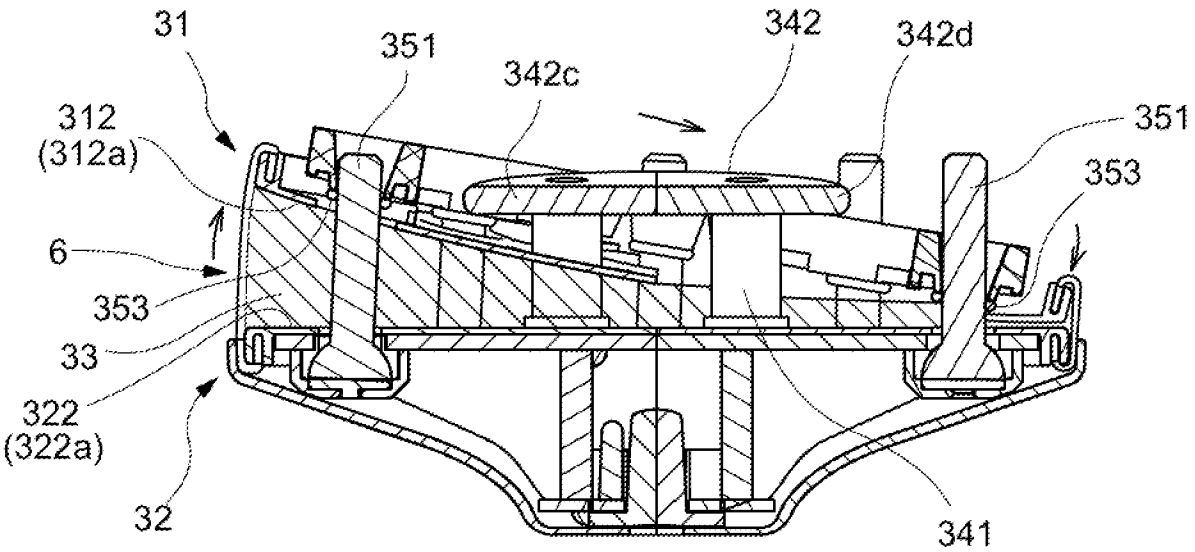
FIG. 23 is a cross-sectional view corresponding to FIG. 21 when the seat is tilted to the left and right.

The movement mechanism 3 supports the upper base unit 31 movably with respect to the lower base unit 32, in the front-rear direction as illustrated in FIGS. 19 to 21, and in the left-right direction as illustrated in FIGS. 21 and 23, and further in directions of 360 degrees including these directions.

Figure 9:
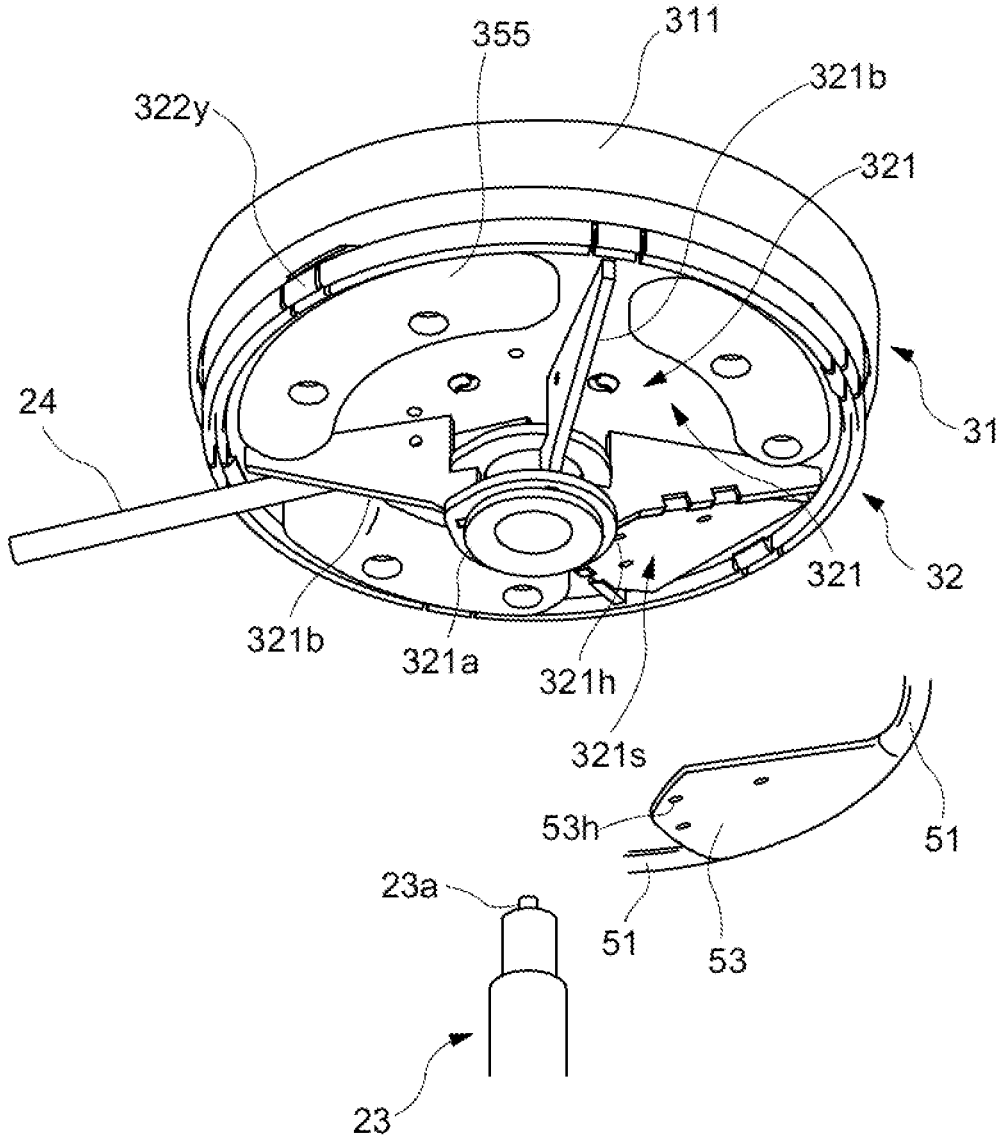
FIG. 9 is a bottom perspective view of the movement mechanism.
Figure 10:
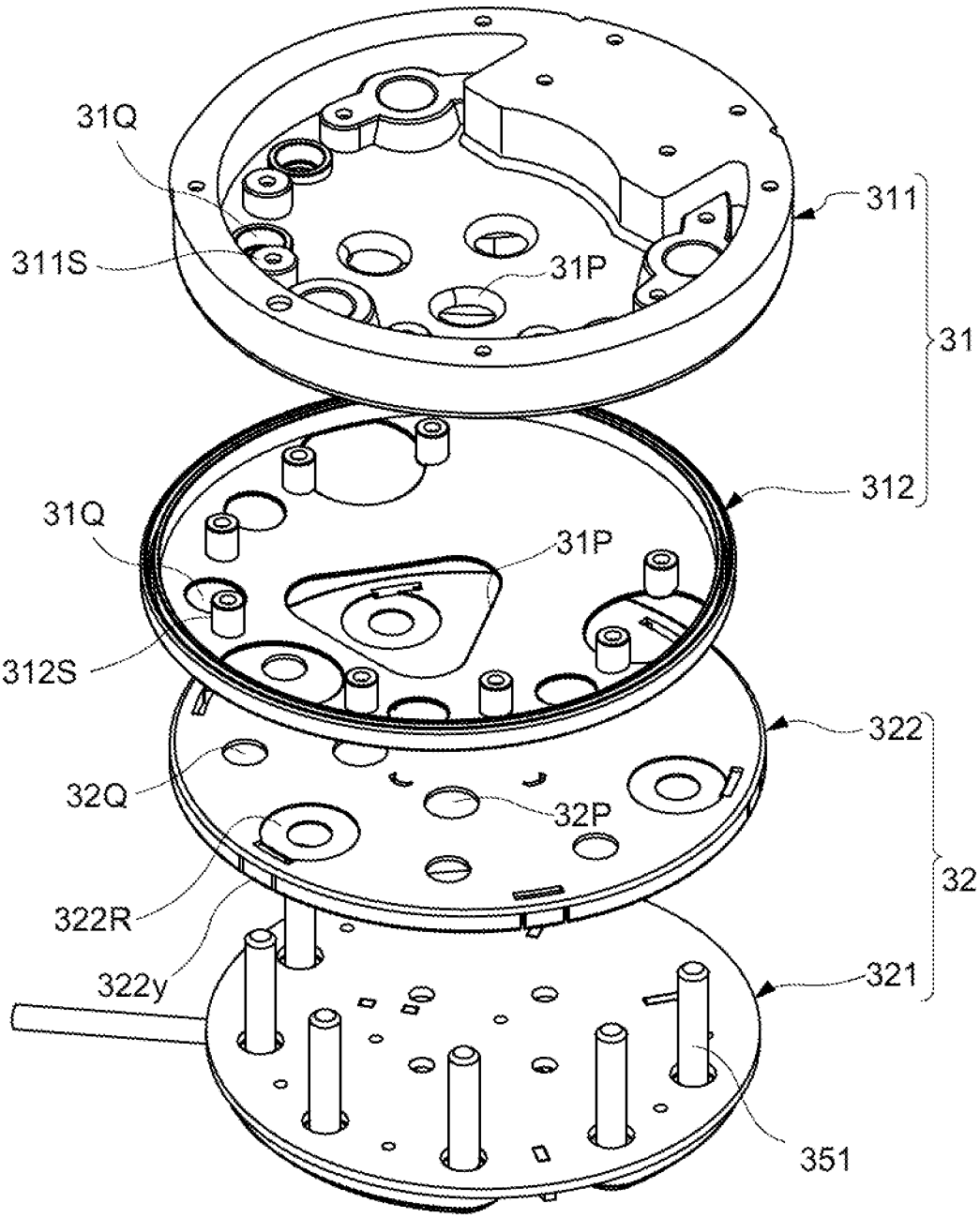
FIG. 10 is an exploded perspective view of the movement mechanism.

As illustrated in FIG. 10, the upper base unit 31 includes a disk-shaped seat receiver 311 and a disk-shaped upper base plate 312 attached under the seat receiver 311. The seat receiver 311 illustrated in FIGS. 7 to 10, and the like is illustrated as a single body, but the seat receiver 311 is actually integrally formed of a resin together with the outer seat shell 132 in the periphery thereof, as illustrated in FIG. 5 and the like. The upper base plate 312 is provided with high nuts 312*s*, and the seat receiver 311 is provided with boss holes 311*s* at positions corresponding to the high nuts 312*s*. In a state where a bottom surface of the seat receiver 311 abuts against a top surface of the high nuts 312*s*, the upper base plate 312 and the seat receiver 311 are coupled by bolts (not illustrated) inserted through the seat receiver 311 and the high nuts 312*s* from above.

As illustrated in FIG. 10, the lower base unit 32 includes a disk-shaped support base unit 321 attached to the upper end of the leg support post 23 and a disk-shaped lower base plate 322 attached on the support base unit 321. In FIG. 10, reference numeral 322*y* indicates an engaging claw provided in the lower base plate 322, and the engaging claw 322*y* engages with a peripheral edge portion of the support base unit 321 so that the lower base plate 322 and the support base unit 321 are integrated. As illustrated in FIGS. 6 and 9, a leg mounting unit 321*a* into which the leg support post 23 is fitted is provided in a bottom surface of the support base unit 321, and the leg mounting unit 321*a* is reinforced by ribs 321*b* extending in a radial direction to increase the rigidity of the leg mounting unit 321*a*. The operated unit 23*a* used to operate a gas spring is provided at the upper end of the leg support post 23 and in a state where the leg support post 23 is inserted into the leg mounting unit 321*a*, the operated unit 23*a* is arranged at a position where the operated unit 23*a* can be operated by an operation unit 24.

Figure 13:
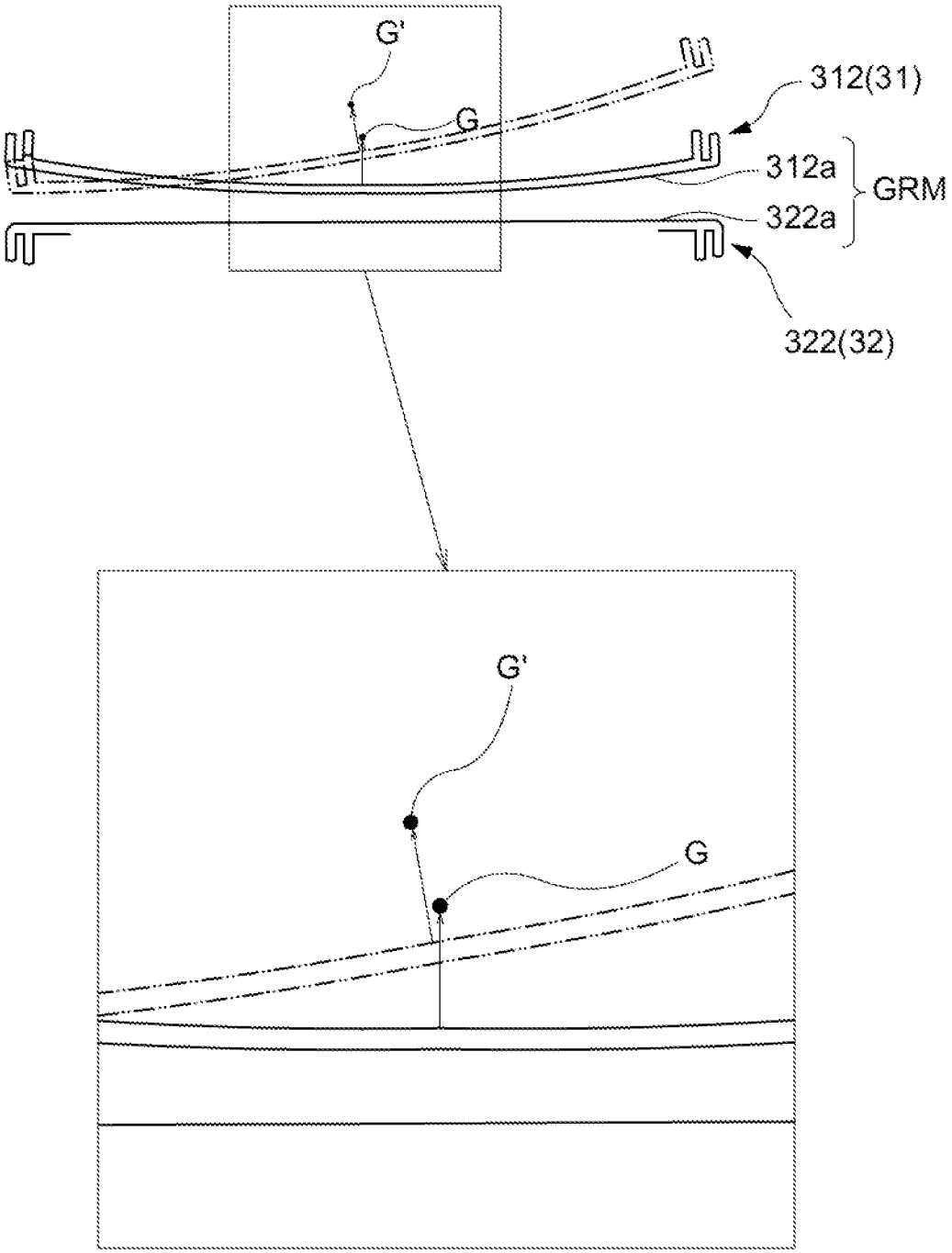
FIG. 13 is a diagram for describing rolling surfaces facing each other constituting the movement mechanism.

FIG. 13 is a schematic view of rolling surfaces constituting the movement mechanism 3, in which the elastic member 33 is omitted. As illustrated in FIG. 13, surfaces of the upper base unit 31 and the lower base unit 32 that face each other (in the present embodiment, a facing surface 312*a* of the upper base plate 312 constituting the upper base unit 31 and a facing surface 322*a* of the lower base plate 322 constituting the lower base unit 32) form rolling surfaces that roll with respect to each other. In the present embodiment, the rolling surface 322*a* of the lower base plate 322 is composed of a flat surface, the rolling surface 312*a* of the upper base plate 312 is composed of a curved surface that bulges toward the rolling surface 322*a* of the lower base plate 322, and a contact section between the upper base unit 31 and the lower base unit 32 changes according to a rolling operation, as illustrated by an imaginary line in FIG. 13. Needlessly to say, the lower base plate 322 may be a curved surface, the upper base plate 312 may be a flat surface, and both the upper base plate 312 and the lower base plate 322 may be curved surfaces.

The curved surface has a substantially partial spherical shape or a substantially arc-shaped cross section, in other words, the curved surface has a bowl-shape or a convex R-shape, and the upper base unit 31 may move in directions of 360 degrees including the front-rear, left-right, and diagonal directions, while rolling on the lower base unit 32. The curved surface may be implemented in various modes, such as a surface that is curved at a constant curvature, even at a position separated from a reference position N which is a contact position between the two base units 31 and 32 when no load is applied, a surface having a curvature that smoothly changes as the distance from the reference position N increases, a surface having different curvature in the front-rear and left-right directions, and a surface having different curvature between the front and the rear.

Figure 11:
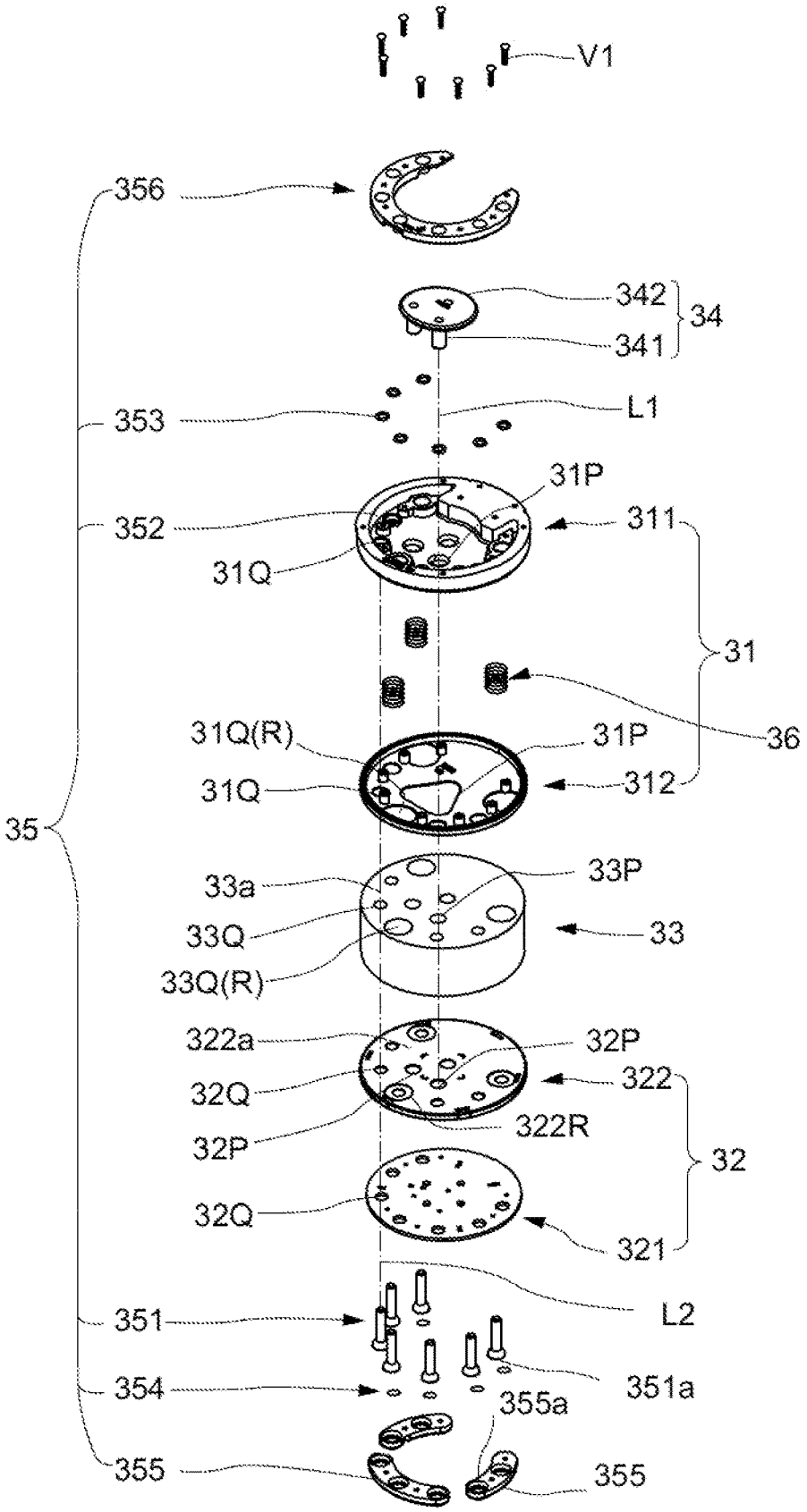
FIG. 11 is a top perspective view obtained by further disassembling components in FIG. 10.
Figure 12:
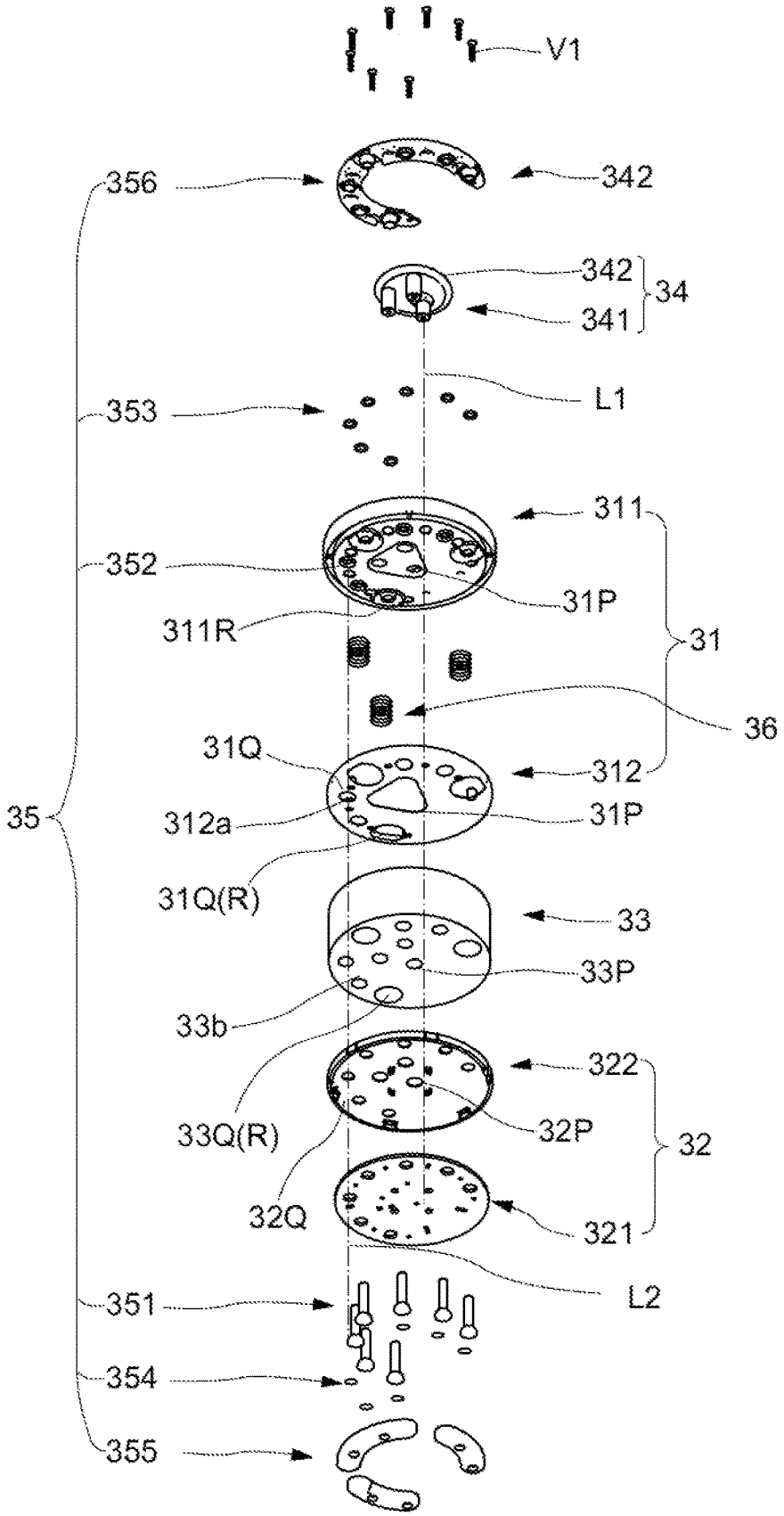
FIG. 12 is a bottom perspective view obtained by further disassembling components in FIG. 10.

As illustrated in FIGS. 10 to 12, the upper base plate 312 and the lower base plate 322 constitute surfaces (rolling surfaces) 312*a* and 322*a* facing each other and moving relative to each other. The upper base plate 312 and the lower base plate 322 also serve as mounting members for mounting the cover member 6 for hiding a gap between the rolling surfaces 312*a* and 322*a*, as described later with reference to FIGS. 25A to 25C. On the other hand, for example, in FIGS. 10 to 12, in a case where the upper base plate 312 and the lower base plate 322 are provided at positions that do not form surfaces facing each other, or in a case where the cover member 6 is attached to a position where a part of the movement mechanism 3 is concealed in another mode, and the like, the bottom surface of the seat receiver 311 and a top surface of the support base unit 321 may form surfaces (rolling surfaces) facing each other. In this case, the upper base plate 312 and the lower base plate 322 are not necessarily required.

As illustrated in FIGS. 11 and 12, the elastic member 33 is attached to the rolling surfaces 312*a* and 322*a* in a state where a top surface 33*a* and a bottom surface 33*b* contact the rolling surfaces 312*a* and 322*a*, respectively, and the elastic member 33 is formed of an elastic resin foam body to form a columnar shape when no load is applied. High-elastic urethane foam, low-elastic urethane foam, and the like may be adopted as the elastic resin foam body. High-elastic urethane foam instantly deforms upon receiving an external force, and thus exerts a buffering effect. Low-elastic urethane foam gradually deforms upon receiving an external force, and thus exerts a delay effect.

In the present embodiment, the high-elastic urethane foam is adopted, because high-elastic urethane foam has low temperature dependence and excellent durability. Needlessly to say, low-elastic urethane foam may be used for the elastic member, or a thin member such as an elastic sheet may be used.

When the upper base unit 31 receives a load and moves in any direction of 360 degrees including the front-rear, left-right, and diagonal directions with respect to the lower base unit 32, as illustrated in FIGS. 19, 20, 23, and the like, the rolling surface 312*a* of the upper base plate 312 moves while compressing the elastic member 33 between the rolling surface 312*a* and the rolling surface 322*a* of the lower base plate 322, and with this movement, the upper base plate 312 tilts downward in a movement direction. A swing operation in which the seat 1 tilts downward in the movement direction according to such a movement of a seated person is realized via the upper base unit 31.

Generally, it is conceivable to use, as the movement mechanism, a guide mechanism composed of a cam and a follower between an upper base unit and a lower base unit, and a link mechanism connecting the upper base unit and the lower base unit. Compared to such a structure, the movement mechanism 3 of the present embodiment utilizes the rolling surfaces 312*a* and 322*a* to realize an operation of the seat 1 in which a tilting movement component is larger than a horizontal movement component. The chair of the present embodiment that performs such an operation is particularly easy to use in a situation where a person frequently sits down and stands up from a seat.

The curvatures of the rolling surfaces 312*a* and 322*a* are set so that a gravity center position G of the seat 1 is lifted to G' by the movement, as illustrated by a solid line and an imaginary line in FIG. 13, and the rolling surfaces 312*a* and 322*a* constitute a gravity return mechanism GRM that generates, according to a body weight, a return force for returning the seat 1 to the reference position N, which is a position when no load is applied.

As illustrated in FIGS. 11 and 12, the movement mechanism 3 is provided with a first connection member 34 that fixes the upper base unit 31 to the lower base unit 32 so that the upper base unit 31 does not separate from the lower base unit 32, and regulates a relative rotation, and a second connection member 35 for imparting a damper function to the movement mechanism 3. The damper function is imparted to suppress an abrupt movement of the seat 1, considering that the movement mechanism 3 of the present embodiment performs a rolling operation and high-elastic urethane foam that deforms quickly is adopted as the elastic member 33.

In addition, in the upper base unit 31, the lower base unit 32, and the elastic member 33, first holes 31P to 33P for inserting a pin 341 constituting the first connection member 34 are opened along a first line L1, and second holes 31Q to 33Q for inserting a shaft 351 constituting the second connection member 35 are opened along a second line L2. The holes 31P, 32P, 33P, 31Q, 32Q, and 33Q prevent the pin 341 and the shaft 351 from interfering with the rolling surfaces 312*a* and 322*a* and the elastic member 33, and thus, are also referred to as "relief holes" herein.

The first connection member 34 is mainly composed of three of the pins 341, and the pins 341 are formed as an integral member with a flange unit 342. The pins 341 are inserted through the first hole 31P of the upper base unit 31 (that is, the first hole 31P of the seat receiver 311 and the first hole 31P of the upper base plate 312), the first hole 33P of the elastic member 33, and the first hole 32P of the lower base unit 32 (that is, the first hole 32P of the lower base plate 322), respectively, and the pins 341 are fastened from below by bolts (not illustrated) at positions where the pins 341 abut against the support base unit 321 constituting the lower base unit 32. FIG. 19 and the like illustrate the state described above. The first holes 31P of the seat receiver 311 are opened at three locations corresponding to the positions of the three pins 341, whereas the first hole 31P of the upper base plate 312 is a large opening for receiving all the three pins 341.

Figure 16:
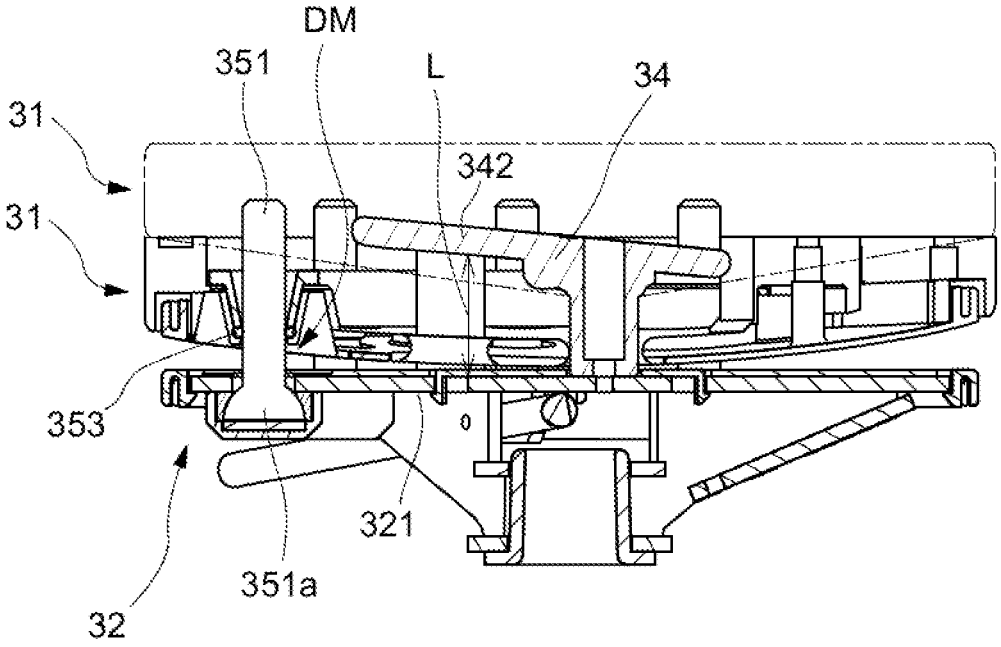
FIG. 16 is a cross-sectional view taken along line XVI-XVI in FIG. 7.

With such a structure, for example, a relative position (distance L) between the flange unit 342 of the first connection member 34 and the support base unit 321 in FIGS. 16 and 21 is fixed. In FIGS. 16 and 21, the elastic member 33 is omitted, and the upper base unit 31 descends almost to the maximum extent as illustrated by a solid line and approaches the lower base unit 32. However, if the elastic member 33 is interposed and a small load is applied, the upper base unit 31 rises to a position indicated by the imaginary line in FIGS. 16 and 21.

When the seat 1 swings in the front-rear direction as illustrated in FIGS. 19 and 20, or in the left-right direction as illustrated in FIG. 23, the upper base unit 31 is movable between the flange unit 342 constituting the first connection member 34 and the support base unit 321 (specifically, in a range of the distance L between the flange unit 342 and the lower base plate 322). The upper base unit 31 moves while compressing the elastic member 33, and thus, when the applied load is released, the upper base unit 31 rises by a return force of the elastic member 33 as illustrated in FIGS. 16 and 21, and as indicated by the imaginary line, the upper base unit 31 is prevented from rising further at a position where a part of the upper base unit 31 abuts against the flange unit 342. The flange unit 342 prevents the upper base unit 31 from being detached upward, and also restricts a tilt angle when the upper base unit 31 is tilted to the front, rear, left, right, or diagonally.

In the present embodiment, as illustrated in FIGS. 16, 19, and 20, the flange unit 342 is provided inclined in the front-rear direction, so that a front end 342*a* is higher than a rear end 342*b*. That is, as illustrated in FIG. 19, when the upper base unit 31 tilts forward, the rear end 342*b* of the flange unit 342 restricts a forward tilt angle of the upper base unit 31, whereas as illustrated in FIG. 20, when the upper base unit 31 tilts rearward, the front end 342*a* of the flange unit 342 restricts a rearward tilt angle of the upper base unit 31, and a larger rearward tilt angle than the forward tilt angle is permitted. As illustrated in FIGS. 21 and 23, a left end 342*c* and a right end 342*d* of the flange unit 342 are at the same height position at the left and right, so that inclination of the upper base unit 31 is possible to the left direction and the right direction at the same angle.

As illustrated in FIGS. 11, 20, and the like, the three pins 341 are each fixed to the support base unit 321, and the pins 341 are inserted through the upper base plate 312 and the seat receiver 311. Therefore, the upper base unit 31 which is a combination of the upper base plate 312 and the seat receiver 311, is prevented from rotating with respect to the lower base unit 32 which is a combination of the support base unit 321 and the lower base plate 322, and the elastic member 33 through which the pins 341 are inserted is also prevented from twisting clockwise or counterclockwise in a plan view. Needlessly to say, the number of pins is not limited to three.

Figure 14:
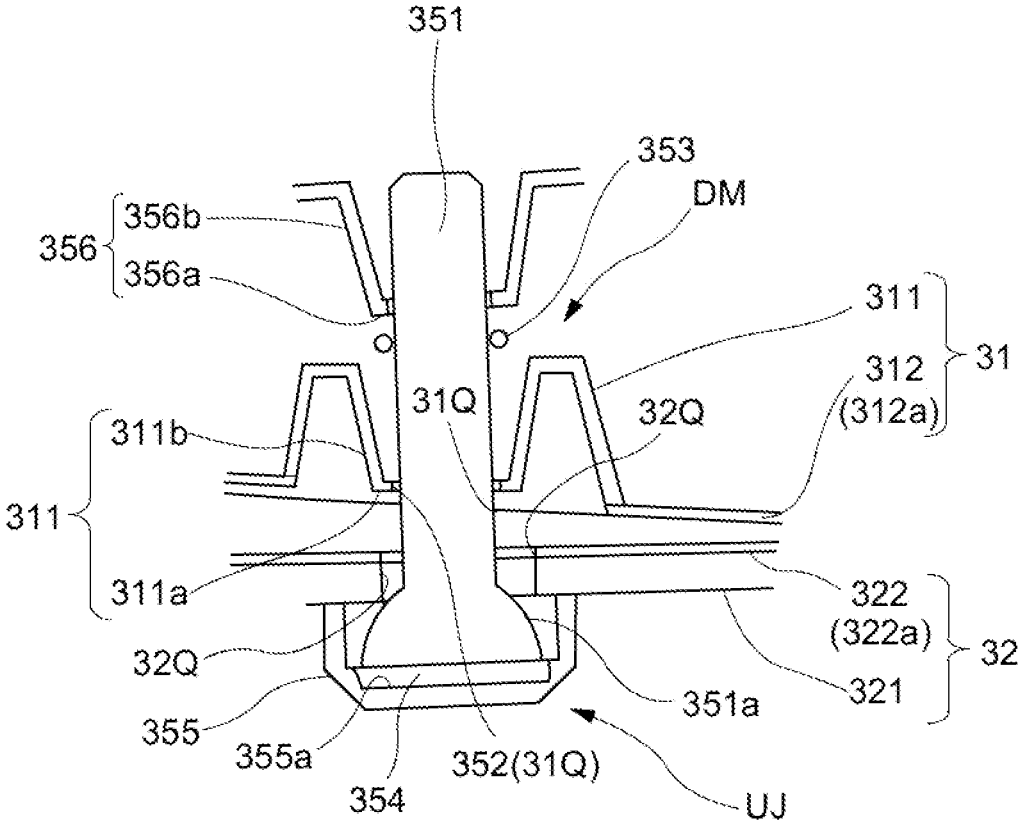
FIG. 14 is a diagram illustrating a built-in structure of a damper mechanism provided together with the movement mechanism.

As described above, the second connection member 35 imparts a damper effect to the operation of the movement mechanism 3. Specifically, as illustrated in FIG. 14 and the like, the second connection member 35 is mainly composed of seven of the shafts 351 which are columnar members, and a damper mechanism DM, which is a braking mechanism, is formed by hole units 311*b* into which the shafts 351 are inserted and O-rings 353 made of a friction material that are arranged between the shafts 351 and the hole units 311*b*. In the present embodiment, the hole units 311*b* correspond to recessed units of ribs provided by forming projections and recesses at a bottom wall of the seat receiver 311 constituting the upper base unit 31, and shaft holes 352 through which the shafts 351 pass are opened at hole bottoms of the hole units 311*b*. Seven sets of the shafts 351, the hole units 311*b*, and the O-rings 353 are provided. Needlessly to say, the number of sets is not limited thereto.

Each of the shafts 351 is a bolt-shaped shaft having a large-diameter proximal end unit 351*a* at a lower end. In a state where the upper end side of the shafts 351 is inserted through the second hole 32Q of the support base unit 321 from the bottom surface side of the support base unit 321, the proximal end unit 351*a* is accommodated in a recessed unit 355*a* of a cocoon-shaped (see FIGS. 11, 12, and the like) abutting plate 355 via an elastic plate 354. In this state, the abutting plate 355 abuts against the bottom surface of the support base unit 321 and is fixed with screws (not illustrated), so that the shafts 351 are attached in a state of protruding upward from the support base unit 321, as illustrated in FIG. 10.

As illustrated in FIGS. 14, 19, 20, and the like, the proximal end unit 351*a* has a spherical or flat spherical shape, and combined with the elastic deformation of the elastic plate 354 interposed between the proximal end unit 351*a* and the abutting plate 355, the shaft 351 is connected to the support base unit 321 of the lower base unit 32 to be swingable around the proximal end unit 351*a*. That is, the proximal end unit 351*a* of the shaft 351, the elastic plate 354, and the recessed unit 355*a* of the abutting plate 355 form a non-directional joint UJ (see FIG. 14). Needlessly to say, another configuration such as a ball joint may be employed as a non-directional joint in which the shaft 351 is swingable around the proximal end.

The shafts 351 protrude upward via the second hole 32Q of the lower base unit 32 (that is, the second hole 32Q of the support base unit 321 and the second hole 32Q of the lower base plate 322), the second hole 33Q of the elastic member 33 (not illustrated in FIG. 14), and the second hole 31Q of the upper base unit 31 (that is, the second hole 31Q of the upper base plate 312 and the second hole (shaft hole) 31Q of the seat receiver 311). The shafts 351 constitute the damper mechanism DM.

Figure 15:
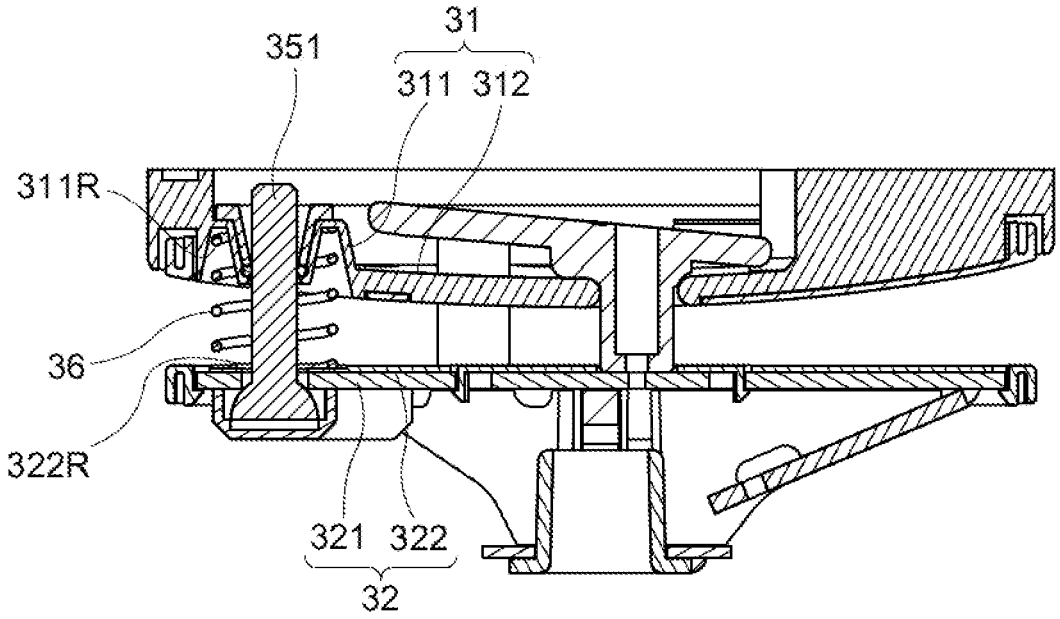
FIG. 15 is a diagram illustrating a built-in structure of a return spring provided together with the movement mechanism.

On the other hand, as illustrated in FIGS. 11, 12, 15, and the like, a return spring 36 serving as a third connection member is interposed around an outer periphery of the shaft 351 to be interposed between the upper base unit 31 and the lower base unit 32 and connect the upper base unit 31 and the lower base unit 32. In the present embodiment, the return spring 36 is a coil spring. In three of the seven second holes 31Q to 33Q described above, a recessed retainer unit 322R that supports a lower end of the return spring 36 in a positioned state is formed on the lower base plate 322 of the lower base unit 32, and the second holes 33Q (R) and 31Q (R) opened at three locations of the elastic member 33 and the upper base plate 312 have a larger diameter than the return spring 36. A recessed retainer unit 311R that accommodates an upper end of the return spring 36 in a positioned state is formed in three corresponding locations among the seven locations where the second holes 31Q are provided in the bottom surface of the seat receiver 311 constituting the upper base unit 31.

The return spring 36 is arranged at a plurality of locations (three locations in the present embodiment) over a range of 180 degrees or more (for example, 270 degrees) around a center position (reference numeral O in FIG. 7) of the movement mechanism 3. Therefore, if the upper base unit 31 is tilted in any direction including the front-rear, left-right, and diagonal directions, the return spring 36 on the tilted side is compressed, and the return spring 36 assists the return force for returning the upper base unit 31 to the reference position N when no load is applied. The back 4 is integrally attached to the seat 1, and thus, the return spring 36 also supports a load of a movable portion including the seat 1 and the back 4. A structure in which the return spring 36 on the side opposite to the tilted side is pulled may be adopted as the configuration of the return spring 36.

As described above, the second connection member 35 has a configuration in which the O-rings 353 made of a friction material are fitted between the shafts 351, which are columnar members, and the hole units 311*b*.

Specifically, as illustrated in FIG. 14, the shaft holes 352 open in a bottom wall 311*a* of the seat receiver 311 constituting the upper base unit 31, and the periphery of the bottom wall 311*a* constitutes the hole units 311*b* that have a tapered shape and open upward.

On the other hand, as illustrated in FIGS. 8, 11, 12, 14, and the like, a pressing tool 356 has a C-shape in a plan view. The pressing tool 356 includes an end unit 356*a* facing the bottom wall 311*a*, and a periphery of the end unit 356*a* constitutes a projecting unit 356*b* that has a tapered shape and protrudes downward.

An inner diameter of the O-rings 353 is chosen so that the O-rings 353 fit with the shafts 351 with a predetermined sliding resistance, and the predetermined sliding resistance is chosen so that a required damper effect can be obtained when the seat 1 swings. In the present embodiment, NBR rubber is used for the O-rings 353. However, the material is not limited thereto, and various materials may be adopted as the material for realizing the sliding resistance.

Figure 7:
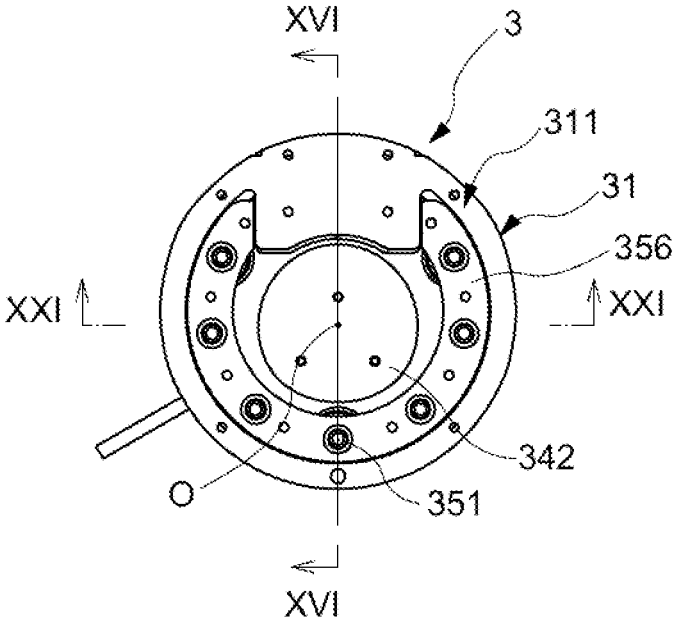
FIG. 7 is a plan view of the movement mechanism.
Figure 8:
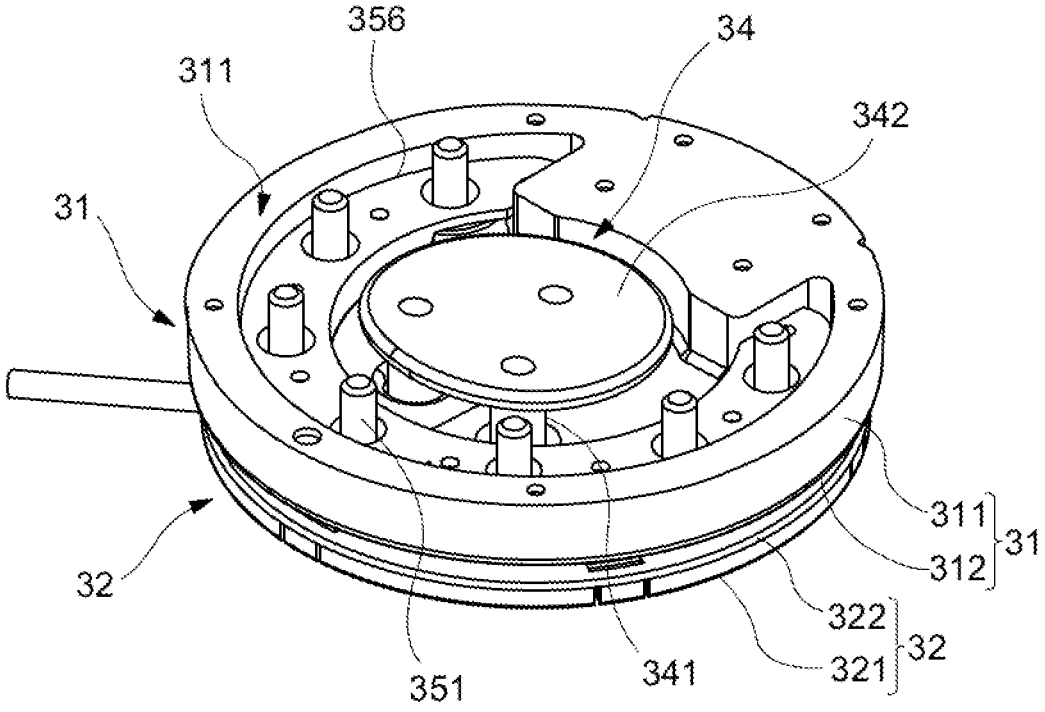
FIG. 8 is a top perspective view of the movement mechanism.

The shafts 351 are passed through the shaft holes 352 and fitted to the O-rings 353 from above, and the pressing tool 356 is pushed from above to fit the projecting unit 356*b* into the hole unit 311*b*. Thus, the O-rings 353 are pressed against the bottom wall 311*a* of the seat receiver 311 by the end unit 356*a* to realize the assembled state illustrated in FIGS. 16, 20, and the like. In this state, the pressing tool 356 is fastened to a top surface of the seat receiver 311 by bolts V1 illustrated in FIGS. 11, 12, and the like, so that the O-rings 353 are fixed to the seat receiver 311 and therefore the upper base unit 31, as illustrated in FIG. 7. At this time, the O-ring 353 illustrated in FIG. 14 is deformed into a flat elliptical shape, and abuts against the outer periphery of the shaft 351 not at a point, but at a surface having an area of a certain size or more.

If the upper base unit 31 swings, as illustrated in FIGS. 19, 20, and the like, the O-rings 353, which are friction members fitted to the shafts 351 while being attached to the seat receiver 311 of the upper base unit 31, change a fitting position with respect to the shafts 351, which are columnar members in which the proximal end unit 351*a* is swingably attached to the lower base unit 32, while sliding along the shafts 351 together with the hole units 311*b*. The shafts 351 swing in response to the swinging of the O-rings 353 and follow the change in angle of the upper base unit 31 with respect to the lower base unit 32. At this time, a relative movement of the hole units 311*b* and the O-rings 353, which are friction members, with respect to the shafts 351, which are columnar members constituting the damper mechanism DM, is a sliding motion along a longitudinal direction of the shafts 351. The shafts 351 may be formed of a bendable and flexible material. In this case, the hole units 311*b* and the O-rings 353 can move along the longitudinal direction of the shafts 351, without swingably supporting the shafts 351.

That is, the damper mechanism DM is arranged at a plurality of locations around a center position of the upper base unit 31 over a range of 180 degrees or more (for example, 270 degrees). Therefore, if the seat 1 moves in any direction of 360 degrees, the shafts 351 and the O-rings 353 operate while following the movement of the seat 1 and sliding relative to each other, and exert a damper action by a sliding resistance in both directions of an operation in which a distance between the upper base unit 31 and the lower base unit 32 is expanded or contracted.

In a chair having such a configuration, in a state where no seating load is applied, the gravity return mechanism GRM mentioned above attempts to return the chair to a position (reference position) where the center of gravity of the movable portion including the upper base unit 31, the seat 1, and the back 4 is lowest. At that time, a restoring force of the elastic member 33 and an auxiliary restoring force of the return spring 36 act together, and thus, the chair stops at the overall most stable position. FIGS. 1 to 3 illustrate a state where the seat 1 is in the reference position N.

The seat 1 of the chair can swing from the reference position N in any direction of 360 degrees including the front-rear, left-right, and diagonal directions, when the upper base plate 312 performs a rolling operation with respect to the lower base plate 322.

Figure 24:
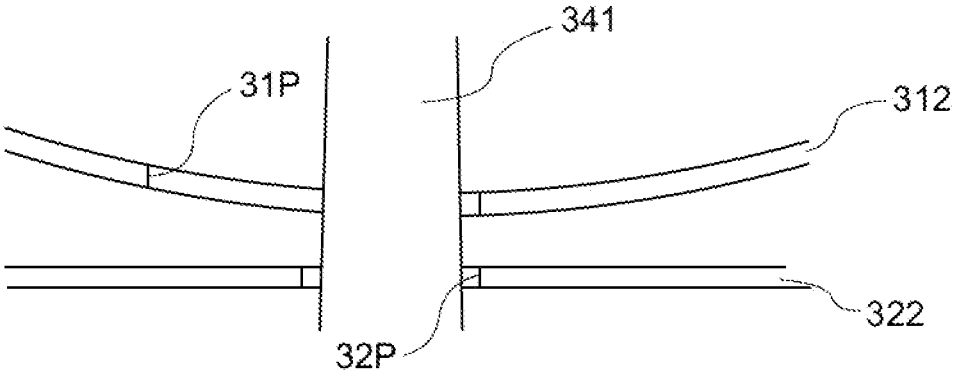
FIG. 24 is a diagram illustrating a built-in structure of a pin provided together with the movement mechanism.

In the rolling surfaces performing such a rolling operation, the upper base plate 312 and the lower base plate 322, which are surfaces facing each other, include the first holes 31P and 32P for passing the pins 341 constituting the first connection member as illustrated in FIG. 24, the second holes 31Q and 32Q for passing the shafts 351 constituting the second connection member as illustrated in FIG. 14, the recessed retainer unit 322R (see FIGS. 11 and 12) for accommodating the return spring 36 which is the third connection member, a return spring insertion hole in the upper base plate 312, and the like. In particular, the first hole 31P in the upper base plate 312 illustrated in FIG. 24 is a hole having a large opening to avoid interference with the three pins 341, and the second holes 31Q and 32Q illustrated in FIG. 14 are provided for each of the shafts 351, so that the number of the second holes 31Q and 32Q is large. As illustrated in FIGS. 11, 12, and the like, three of the second holes 31Q and 32Q have a large diameter so that the return spring 36 can also pass through.

In the holes 31P, 32P, 31Q, 32Q, and the like, regions having different so-called curvatures are formed and the continuity of the rolling surfaces 312*a* and 322*a* is impaired. Therefore, if the upper base plate 312 constituting the upper base unit 31 rolls directly on the lower base plate 322 constituting the lower base unit 32, the upper base unit 31 is likely to rattle due to the change in the curvature. The rattling propagates as a rattling of the seat 1.

On the other hand, in the present embodiment, the elastic member 33 is interposed between the above-described region in one of the upper base unit 31 and the lower base unit 32 and a corresponding region in the other one of the upper base unit 31 and the lower base unit 32. The elastic member 33 lowers the stability when opening peripheral edges of the holes 31P, 31Q, and the like existing in the rolling surface 312*a* of the upper base unit 31 abut against the rolling surface 322*a* of the lower base unit 32 facing the rolling surface 312*a*, and lowers the stability when opening peripheral edges of the holes 32P and 32Q existing in the rolling surface 322*a* of the lower base unit 32 abut against the rolling surface 312*a* of the upper base unit 31 facing the rolling surface 322*a*. That is, the elastic member 33 facilitates rolling between the rolling surfaces 312*a* and 322*a* at a place where the curvature of the rolling surfaces 312*a* and 322*a* changes and smooths the change of the curvature. Needlessly to say, even in a place where no hole is formed, and also a place where the surface of the rolling surfaces 312*a* and 322*a* is irregular or deteriorated, the elastic member has an effect of reducing the rattling caused by the irregular or deteriorated surface.

As illustrated in FIGS. 20, 23, and the like, the distance between the upper base unit 31 and the lower base unit 32, which are rolling surfaces facing each other, is smaller on the side to which the upper base unit 31 is tilted and larger on the opposite side. The elastic member 33 is interposed between the upper base unit 31 and the lower base unit 32, and thus, the elastic member 33 is elastically restored on the larger side and the elastic member 33 is compressed on the smaller side, until a thickness of the elastic member 33 is very small. The elastic member 33 accommodates the pins 341 that form the main body of the first connection member 34 and the shafts 351 that form the second connection member 35 in the first holes 33P and the second holes 33Q, and thus the elastic member 33 conceals the pins 341 and shafts 351 as viewed sideways. However, the elastic member 33 does not hide a gap between the upper base unit 31 and the lower base unit 32, and thus, does not include a function of preventing foreign bodies from entering the gap. Unlike between the rolling surfaces 312*a* and 322*a*, there is no direct or indirect contact, however, it is also necessary to hide a region between a pair of swinging surfaces including surfaces facing each other, and thus the circumstance is common.

Figure 25A:
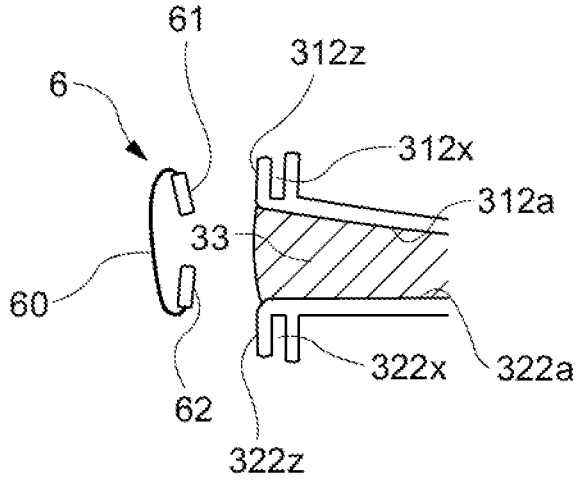
FIGS. 25A to 25C are diagrams illustrating a mounting structure of a cover member.

Therefore, in the present embodiment, as illustrated in FIGS. 20, 25A, and the like, the elastic member 33 is arranged at a portion extending from the vicinity of outer peripheral edges 312*z* and 322*z* of both swinging surfaces 312*a* and 322*a* facing each other to the inside thereof, and a stretchable sheet material 60 is provided between the outer peripheral edges 312*z* and 322*z* to conceal a gap between the swinging surfaces 312*a* and 322*a* facing each other, including the elastic member 33.

Figure 25B:
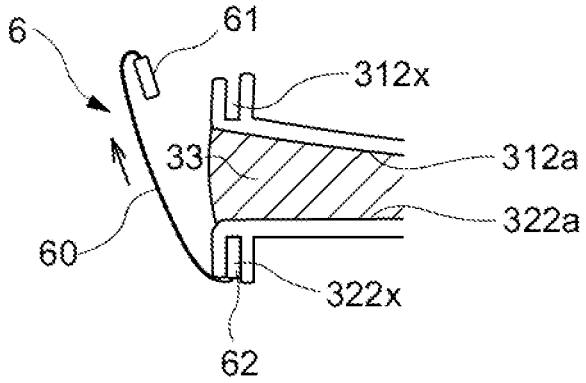
Figure 25C:
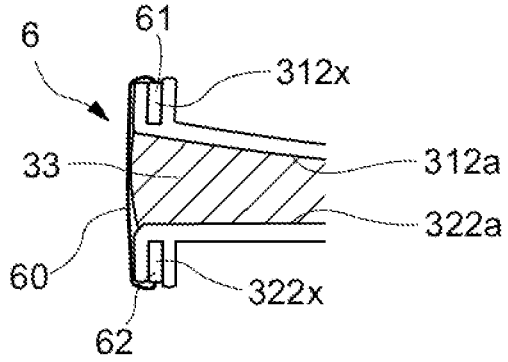

Specifically, grooves 312*x* and 322*x* extending along the outer peripheral edges 312*z* and 322*z* and opening in opposite directions are provided in the vicinity of the outer peripheral edges 312*z* and 322*z* of the swinging surfaces 312*a* and 322*a* facing each other, and in the cover member 6, deformable strips 61 and 62 are attached to edge portions of the stretchable sheet material 60. As illustrated in FIGS. 25B and 25C, the strips 61 and 62 are sequentially pushed into the grooves 312*x* and 322*x* to be mounted to the grooves 312*x* and 322*x*. As a result, the cover member 6 conceals a gap between the upper base plate 312 and the lower base plate 322, which form facing swinging surfaces. The strips 61 and 62 may be mounted to the grooves 312*x* and 322*x* in any order.

For example, the stretchable sheet material 60 is formed by using a material obtained by knitting polyester fibers. In the present embodiment, the stretchable sheet material 60 is sewn or formed into a cylindrical shape, and the strips 61 and 62 made of resin and having an annular thin plate shape are integrally provided at the upper end and the lower end of the stretchable sheet material 60. The size and elasticity of the stretchable sheet material 60 are chosen so that no wrinkles are generated when the gap is most narrow and so that the stretchable sheet material 60 does not hinder the operation of the swinging surface when the gap is widened. The relationship between the grooves 312*x* and 322*x* and the strips 61 and 62 is one-to-one, and each of the strips 61 and 62 corresponds to the entire area of one of the grooves 312*x* and 322*x*, and the strips 61 and 62 are provided having a length that surrounds the grooves 312*x* and 322*x*. Needlessly to say, the material of the stretchable sheet material 60 is not limited to the above-described materials, and various materials such as cloth, upholstery, woven fabric, and knitted items can be used, as long as the material can be stretched and contracted and covers the inside. The stretchable sheet material 60 that can hide the inside is used, but the stretchable sheet material 60 may be a material through which the inside is slightly visible.

As illustrated in FIGS. 19, 20, and the like, when the upper base unit 31 moves with respect to the lower base unit 32, the cover member 6 follows the movement by deforming, in addition to stretching and contracting, according to the movement of the gap between the rolling surfaces 312*a* and 322*a* and continues to conceal the gap expanding and contracting between the upper base unit 31 and the lower base unit 32.

As illustrated in FIG. 1, the back 4 is provided with a back main body 42 at an upper end of a back support rod 41, and is attached to the seat 1 to swing together with the seat 1 as described above. Specifically, as illustrated in FIG. 5, a rear edge 132*a* of the outer seat shell 132 is provided with a flat insertion port 132*b* that opens rearward. On the other hand, a lower end front edge 41*a* of the back support rod 41 constituting the back 4 has a shape in accordance with the rear edge 132*a* of the outer seat shell 132, and an insertion unit 41*b* that can be inserted into the insertion port 132*b* of the outer seat shell 132 is provided. The insertion unit 41*b* is inserted into the insertion port 132*b*, and then bolts (not illustrated) are inserted into bolt holes 132*c* and 41*c* to join the insertion unit 41*b* and the insertion port 132*b*. A wooden material is used for the back main body 42 of the present embodiment.

As illustrated in FIG. 1, the arms 5 are provided with arm rests 52 at upper ends of an arm rod 51, and are attached not to swing with respect to the seat 1 and the back 4 as described above. Specifically, as illustrated in FIGS. 3 and 9, an arm mounting location 321*s* is set at a rear portion of the bottom surface of the support base unit 321 where the cocoon-shaped abutting plate 355 is not provided. On the other hand, the left and right arm rests 52 are connected by the arm rod 51, and a proximal end of the arm rod 51 is attached to a common bracket 53. The bracket 53 is arranged at the arm mounting location 321*s*, and a bolt (not illustrated) is fastened through a hole 53*a* of the bracket 53 and a hole 321*h* provided in the bottom surface of the support base unit 321 from below. The arm rod 51 extends from this position to the left or right along the bottom surface of the seat 1, rises upward from the vicinity of the rear edge of the seat 1, and then extends forward. The arm rests 52 are arranged at the portions of the arm rod 51 extending forward.

As described above, the chair of the present embodiment includes the upper base unit 31 and the lower base unit 32 facing each other, and the seat 1 that is provided in the upper base unit 31 and swings when the upper base unit 31 rolls with respect to the lower base unit 32, and the upper base unit 31, which is at least one of the upper base unit 31 and the lower base unit 32, includes the rolling surface 312*a* being curved. In the chair, a region having a different curvature exists in a part of the rolling surface 312*a*, and the elastic member 33 is interposed between the region having the different curvature and a corresponding region of an opposing surface.

According to such a configuration, the upper base unit 31 can follow the movement of the seated person while rolling via the rolling surface 312*a*, and thus, the seated person can easily find a weight balance while supporting his or her own weight, and can change his or her posture stably and continuously. At that time, even if a region having a different curvature exists in a part of the rolling surface 312*a*, the elastic member 33 interposed between the region of the rolling surface 312*a* and a corresponding region of the opposing surface makes it possible to effectively prevent rattling and generation of an undesirable noise due to the change in curvature, during the operation of the upper base unit 31, and therefore, the operation of the seat 1.

Specifically, the first and second connection members 34 and 35 that connect the upper base unit 31 and the lower base unit 32 are provided, and regions having different curvatures are formed by the relief holes 31P, 32P, 31Q, and 32Q for inserting the first and second connection members 34 and 35.

Such relief holes 31P, 32P, 31Q, and 32Q contact the opposing surface only in the periphery of the hole and there is no contact in the inside of the hole, and thus the relief holes 31P, 32P, 31Q, and 32Q tend to form stabilization points, which cause rattling or the like. In contrast, if the elastic member 33 is interposed at such a position, no highly stable state is created between the periphery of the hole and the opposing surface, and the change in the contact state is smoothed, and thus it is possible to attenuate occurrence of rattling and undesirable noise. Thus, the connection members 34 and 35 can be arranged in a part of the rolling surfaces 312*a* and 322*a*, and thus the degree of freedom in design is improved.

In particular, the upper base unit 31 swings in a direction of 360 degrees with respect to the lower base unit 32, and the relief holes 31P, 32P, 31Q, and 32Q are provided at three or more locations around the swing center.

In a case where such a configuration is used and the seat 1 moves in a direction of 360 degrees including the front-rear, left-right, and diagonal directions, if the connection members 34 and 35 are provided in an outer periphery of the upper base unit 31 and the lower base unit 32 to avoid interference with the rolling surfaces 312*a* and 322*a*, the entire mechanism including the connection members 34 and 35 is very large when viewed in a plan view. In contrast, in the configuration of the present embodiment, the connection members 34 and 35 can be arranged in a part of the rolling surfaces 312*a* and 322*a* and do not need to be arranged on the outside, and thus it is possible to avoid an unnecessarily increase in the size of the components of the mechanism including the connection members 34 and 35 when viewed in a plan view. In other words, the size of the rolling surfaces 312*a* and 322*a* can be increased as much as possible within an allowable range.

The pins 341 constituting the first connection member 34 of the present embodiment are rotation stop members that restrict a relative movement of the upper base unit 31 and the lower base unit 32 in a rotation direction, and may be passed through the rolling surfaces 312*a* and 322*a* to obtain an appropriate arrangement of the rotation stop members.

The pins 341 constituting the first connection member 34 of the present embodiment are also detachment stop members that restrict a separation between the upper base unit 31 and the lower base unit 32, and may be passed through the rolling surfaces 312*a* and 322*a* to obtain an appropriate arrangement of the detachment stop members.

The shafts 351 constituting the second connection member 35 of the present embodiment are constitution components of the damper mechanism DM which is a braking mechanism that slows down the movement of the seat 1 by a relative movement between two members, and may be passed through the rolling surfaces 312*a* and 322*a* to obtain an appropriate arrangement of the damper mechanism DM.

The third connection member 36 of the present embodiment is a return spring interposed between the upper base unit 31 and the lower base unit 32 to return the upper base unit 31 to the predetermined reference position N with respect to the lower base unit 32, and may be passed through the rolling surfaces 312*a* and 322*a* to obtain an appropriate arrangement of the return spring 36.

In the present embodiment, an elastic resin foam body interposed between the upper base unit 31 and the lower base unit 32 is employed as the elastic member 33.

With such a configuration, it is possible to impart an appropriate thickness to the elastic resin foam body, and, for example, by selecting a proper elastic resin foam body from various materials, including an elastic resin foam body having low resilience and an elastic resin foam body having high resilience, it is possible to easily impart various characteristics such as a cushioning effect and a delay effect.

Needless to say, as the elastic member, an elastic sheet may be interposed between the upper base unit 31 and the lower base unit 32, and thereby, the space between the rolling surfaces 312*a* and 322*a* can be flattened and the space between the upper base unit 31 and the lower base unit 32 can be compact.

In the present embodiment, the elastic member 33 is also provided with the relief holes 33P and 33Q, and thus, the space between the upper base unit 31 and the lower base unit 32 can be sufficiently filled with the elastic member 33, except for the relief holes 33P and 33Q.

In the present embodiment, the arms 5 are attached to the lower base unit 32 and the seat 1 is attached to the upper base unit 31. When the upper base unit 31 rotates with respect to the lower base unit 32, a positional relationship between the seat 1 and the arms 5 changes. However, if the rotation stop member 34 mentioned above is employed, it is possible to maintain an appropriate state of the chair.

The embodiment of the present invention has been described, and a specific configuration of each unit is not limited to that in the embodiment described above and various modifications are possible without departing from the gist of the present invention.

REFERENCE SIGNS LIST

1 . . . Seat
5 . . . Arm
31 . . . Upper base unit
31P, 32P, 31Q, 32Q . . . Region having different curvature (relief hole)
32 . . . Lower base unit
33 . . . Elastic member
33P, 33Q . . . Relief hole
34 . . . First connection member
35 . . . Second connection member
36 . . . Third connection member (return spring)
312*a*, 322*a* . . . Rolling surface

341 . . . Pin (rotation stop member, detachment stop member)

351 . . . Shaft (constitution component of damper mechanism)

What is claimed is:

1. A chair comprising:

an upper base unit and a lower base unit facing each other, at least one of the upper base unit and the lower base unit including a rolling surface being curved, wherein an opening portion exists in a part of the rolling surface, and an elastic member is interposed between the opening portion and a corresponding region of an opposing surface;

a seat that is provided in the upper base unit and swings when the upper base unit rolls with respect to the lower base unit, a connection member that connects the upper base unit and the lower base unit, wherein the opening portion is a relief hole for inserting the connection member, wherein the upper base unit swings in a direction of 360 degrees with respect to the lower base unit, and the relief hole is provided at three or more locations around a swing center.

2. The chair according to claim 1, wherein the connection member is a rotation stop member that restricts a relative movement of the upper base unit and the lower base unit in a rotation direction.

3. The chair according to claim 2, wherein an arm is attached to the lower base unit and the seat is attached to the upper base unit.

4. The chair according to claim 1, wherein the connection member is a detachment stop member that restricts a separation between the upper base unit and the lower base unit.

5. A chair comprising:

an upper base unit and a lower base unit facing each other, at least one of the upper base unit and the lower base unit including a rolling surface being curved, wherein an opening portion exists in a part of the rolling surface, and an elastic member is interposed between the opening portion and a corresponding region of an opposing surface;

a seat that is provided in the upper base unit and swings when the upper base unit rolls with respect to the lower base unit, a connection member that connects the upper base unit and the lower base unit, wherein the opening portion is a relief hole for inserting the connection member, wherein the connection member forms a braking mechanism that slows down a movement of the seat by a relative movement of two members.

6. The chair according to claim 5, wherein the elastic member is an elastic resin foam body interposed between the upper base unit and the lower base unit.

7. The chair according to claim 5, wherein the elastic member is an elastic sheet interposed between the upper base unit and the lower base unit.

8. The chair according to claim 5, wherein the elastic member is also provided with a relief hole.

9. A chair comprising:

an upper base unit and a lower base unit facing each other, at least one of the upper base unit and the lower base unit including a rolling surface being curved, wherein an opening portion exists in a part of the rolling surface, and an elastic member is interposed between the opening portion and a corresponding region of an opposing surface;

a seat that is provided in the upper base unit and swings when the upper base unit rolls with respect to the lower base unit, a connection member that connects the upper base unit and the lower base unit, wherein the opening portion is a relief hole for inserting the connection member, wherein the connection member is a return spring interposed between the upper base unit and the lower base unit and the return spring returns the upper base unit to a predetermined reference position with respect to the lower base unit.

10. The chair according to claim 9, wherein the elastic member is an elastic resin foam body interposed between the upper base unit and the lower base unit.

11. The chair according to claim 9, wherein the elastic member is an elastic sheet interposed between the upper base unit and the lower base unit.

12. The chair according to claim 9, wherein the elastic member is also provided with a relief hole.

13. The chair according to claim 1, wherein the elastic member is an elastic resin foam body interposed between the upper base unit and the lower base unit.

14. The chair according to claim 1, wherein the elastic member is an elastic sheet interposed between the upper base unit and the lower base unit.

15. The chair according to claim 1, wherein the elastic member is also provided with a relief hole.

* * * * *